US012667153B2

(12) United States Patent
Kim

(10) Patent No.: US 12,667,153 B2
(45) Date of Patent: Jun. 30, 2026

(54) HAIR EXTENSION APPARATUS

(71) Applicant: SHAKE-N-GO FASHION, INC., Port Washington, NY (US)

(72) Inventor: Susan Kim, Manhasset, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 129 days.

(21) Appl. No.: 18/631,578

(22) Filed: Apr. 10, 2024

(65) Prior Publication Data

US 2024/0251899 A1 Aug. 1, 2024

Related U.S. Application Data

(63) Continuation-in-part of application No. 18/477,706, filed on Sep. 29, 2023, which is a continuation-in-part of application No. 17/577,521, filed on Jan. 18, 2022, now Pat. No. 11,839,251, which is a continuation of application No. 17/228,196, filed on Apr. 12, 2021, now Pat. No. 11,246,364, which is a continuation of application No. 16/692,479, filed on Nov. 22, 2019, now Pat. No. 10,993,493, which is a continuation of (Continued)

(51) Int. Cl.
*A41G 5/00* (2006.01)

(52) U.S. Cl.
CPC ..... *A41G 5/0046* (2013.01); *A41G 5/0073* (2013.01)

(58) Field of Classification Search
CPC ..... A61C 3/005; A61C 3/0008; A61C 3/0066; A61C 3/0086; A61C 3/0075; A61C 3/0016; A61C 3/0041; A61C 5/004; A61C 5/0086; A61C 5/0046; A61C 5/0073; A41G 3/005; A41G 3/0008; A41G 3/0066; A41G 3/0086; A41G 3/0075; A41G 3/0016; A41G 3/0041; A41G 5/004; A41G 5/0086; A41G 5/0046; A41G 5/0073

See application file for complete search history.

(56) References Cited

U.S. PATENT DOCUMENTS 3,910,292 A 10/1975 Izzo
3,980,092 A * 9/1976 Garufi ..... A41G 5/0073 132/53

(Continued)

FOREIGN PATENT DOCUMENTS

DE 2117648 A1 10/1971
FR 3095925 A1 2/2022

(Continued)

*Primary Examiner* — Nicholas D Lucchesi
(74) *Attorney, Agent, or Firm* — Brian R. Volk

(57) ABSTRACT

A hair extension apparatus, comprising: a first base member comprising a first front edge, a first rear edge, a first top surface and a first bottom surface; a sleeve member coupled to the first base member along the first front edge, the sleeve member comprising a hole; a second base member at least partially disposed within the sleeve member, the second base member comprising a first end, a second end, a second top surface and a second bottom surface; a first artificial hair section comprising artificial hair, wherein the first artificial hair section is coupled to the first top surface of the first base member; and a second artificial hair section comprising artificial hair, wherein the second artificial hair section is coupled to the second top surface of the second base member.

19 Claims, 26 Drawing Sheets

Related U.S. Application Data application No. PCT/US2019/061234, filed on Nov. 13, 2019.

(60) Provisional application No. 62/912,176, filed on Oct. 8, 2019, provisional application No. 62/890,330, filed on Aug. 22, 2019, provisional application No. 62/857,945, filed on Jun. 6, 2019, provisional application No. 62/760,289, filed on Nov. 13, 2018.

(56) References Cited

U.S. PATENT DOCUMENTS

| | | | | |
|---|---|---|---|---|
| 5,647,384 | A | 7/1997 | Haber et al. | |
| 5,899,211 | A | 5/1999 | Brown | |
| 5,937,867 | A | 8/1999 | Williams | |
| 6,019,017 | A | 2/2000 | Lin | |
| 6,263,884 | B1 | 7/2001 | Minnelli | |
| 7,735,495 | B2 | 6/2010 | Lane et al. | |
| 8,584,682 | B1 | 11/2013 | Naylor | |
| 9,107,460 | B1 * | 8/2015 | Synn | A41G 3/0016 |
| 9,138,024 | B1 | 9/2015 | Solomon | |
| 9,486,023 | B1 * | 11/2016 | Kim | A41G 3/005 |
| 9,930,919 | B1 | 4/2018 | Branker et al. | |
| 10,327,493 | B2 | 6/2019 | Robertson et al. | |
| 10,463,098 | B2 | 11/2019 | Kim et al. | |
| 11,191,312 | B2 | 12/2021 | Kim et al. | |
| 11,470,901 | B2 | 10/2022 | Mayer | |
| 11,771,157 | B1 | 10/2023 | McClain | |
| D1,032,101 | S | 6/2024 | Calle | |
| 2007/0221239 | A1 * | 9/2007 | Lee | A41G 5/0073 132/201 |
| 2007/0272263 | A1 | 11/2007 | Gold | |
| 2008/0047572 | A1 | 2/2008 | Park | |
| 2008/0178902 | A1 | 7/2008 | Moeszinger | |
| 2008/0257369 | A1 | 10/2008 | Poole | |
| 2008/0264435 | A1 | 10/2008 | Kugel | |
| 2009/0188512 | A1 | 7/2009 | Eaton | |
| 2009/0235945 | A1 | 9/2009 | Eaton | |
| 2010/0065078 | A1 | 3/2010 | Reece | |
| 2011/0180091 | A1 | 7/2011 | Wilson | |
| 2011/0209719 | A1 | 9/2011 | Anzivino | |
| 2013/0247930 | A1 | 9/2013 | Norman | |
| 2015/0013710 | A1 | 1/2015 | Buzaglo et al. | |
| 2015/0040935 | A1 | 2/2015 | Sumpter et al. | |
| 2015/0189936 | A1 | 7/2015 | Murphy | |
| 2015/0223538 | A1 | 8/2015 | Yanniello | |
| 2015/0257469 | A1 | 9/2015 | Curbeon | |
| 2015/0327611 | A1 | 11/2015 | Kleinman | |
| 2016/0143381 | A1 | 5/2016 | Helmers et al. | |
| 2016/0278497 | A1 | 9/2016 | Sonstegard et al. | |
| 2018/0035738 | A1 | 2/2018 | Hayes | |
| 2018/0103740 | A1 | 4/2018 | Kennedy | |
| 2018/0177255 | A1 | 6/2018 | Sandoval et al. | |
| 2019/0059487 | A1 | 2/2019 | Kim et al. | |
| 2020/0085125 | A1 * | 3/2020 | Tokunaga | A41G 3/005 |
| 2020/0281293 | A1 | 9/2020 | Goodstein | |
| 2021/0153584 | A1 | 5/2021 | Bernard | |
| 2021/0244153 | A1 | 8/2021 | Cotton | |
| 2024/0138504 | A1 * | 5/2024 | Taylor | A41G 5/0073 |

FOREIGN PATENT DOCUMENTS

| | | | |
|---|---|---|---|
| KR | 2008-0006464 | U | 12/2008 |
| KR | 2013-0001419 | A | 1/2013 |
| KR | 1834312 | A | 1/2013 |
| KR | 2016-0017825 | A | 2/2016 |
| KR | 101625054 | B1 | 6/2016 |
| KR | 20170060374 | A | 6/2017 |
| KR | 10-1821386 | B1 | 1/2018 |
| KR | 200490151 | Y1 | 10/2019 |
| KR | 102064541 | B1 | 1/2020 |

* cited by examiner

HAIR EXTENSION APPARATUS

CROSS-REFERENCE TO RELATED APPLICATIONS

This application is a continuation-in-part application of U.S. application Ser. No. 18/477,706, filed on Sep. 29, 2023, which is a continuation-in-part application of U.S. application Ser. No. 17/577,521, filed on Jan. 18, 2022, now U.S. Pat. No. 11,839,251, which is a continuation application of U.S. application Ser. No. 17/228,196, filed on Apr. 12, 2021, now U.S. Pat. No. 11,246,364, which is a continuation application of U.S. application Ser. No. 16/692,479, filed on Nov. 22, 2019, now U.S. Pat. No. 10,993,493, which is a continuation application of PCT/US2019/061234, filed on Nov. 13, 2019, which claims priority to U.S. Provisional Application No. 62/760,289, filed on Nov. 13, 2018, U.S. Provisional Application No. 62/857,945, filed on Jun. 6, 2019, U.S. Provisional Application No. 62/890,330, filed on Aug. 22, 2019, and U.S. Provisional Application No. 62/912,176, filed on Oct. 8, 2019. The entire content of each of the above patent applications is incorporated herein by reference.

BACKGROUND OF THE INVENTION

Field of the Invention

The present invention relates generally to hair extensions, and more particularly, to a hair extension apparatus that is coupled to a user's natural hair.

Description of the Related Art

Hair extensions and wigs are used by people to enhance their appearance. Wigs generally include multiple strands of hair attached to a cap to form a unit that can be secured to an user's scalp. Hair weaves and hair extensions are also used by people to either conceal or supplement their natural hair. In some cases, people use wigs when they are experiencing baldness or thinning of their natural hair. For those experiencing baldness or thinning of natural hair, use of wigs provides an alternative to use of potentially dangerous hair growth drugs or chemicals, or uncomfortable hair plugs. In other cases, people use wigs for temporary purposes when they are undergoing medical treatments that result in loss of their hair, such as chemotherapy.

Hair extensions and wigs are also used to provide a user with an alternative hair color in order to improve their appearance. Furthermore, hair extensions and wigs can be used by people to present an alternative texture to their own hair, such as changing their hair from straight to curly. Just as many people enjoy accessorizing their wardrobe, people who wear hair extensions and wigs enjoy changing and enhancing their appearance.

SUMMARY OF THE INVENTION

Embodiments of the invention described herein provide a hair extension apparatus. According to an embodiment, a hair extension apparatus, comprises: a first base member comprising a first front edge, a first rear edge, a first top surface and a first bottom surface; a sleeve member coupled to the first base member along the first front edge, the sleeve member comprising a hole; a second base member at least partially disposed within the sleeve member, the second base member comprising a first end, a second end, a second top surface and a second bottom surface; a first artificial hair section comprising artificial hair, wherein the first artificial hair section is coupled to the first top surface of the first base member; and a second artificial hair section comprising artificial hair, wherein the second artificial hair section is coupled to the second top surface of the second base member.

In certain embodiments: the sleeve member extends along the entire first front edge; the sleeve member is adjacent to the first side edge and the second side edge but does not extend around any portion of the first rear edge; the first side edge and the second side edge are not coupled together; the hole is adjacent to the first side edge; the first end of the second base member is coupled to the interior of the sleeve member; the second end of the second base member is not within the sleeve member; a fastener member is coupled to the first bottom surface of the first base member; the fastener member is coupled to the first front edge overlapping the first end of the second base member; the fastener member is a comb that includes tines; the tines of the fastener member are disposed pointing in a direction away from the second side edge towards the first side edge; a hair band member is coupled to the bottom surface of the first base member; the hair band member is coupled to the bottom surface adjacent to the first rear edge and adjacent to the second side edge; the hair band member is disposed on the same side of the first base member as the fastener member; the hair band member is disposed on the same side of the first base member as the second end of the second base member; the hair band member is configured as a loop and is constructed of an elastic material; a first wire member is coupled to the bottom surface of the first base member, wherein the first wire member is disposed adjacent to the first rear edge; a shape of the first wire member is substantially identical to a shape of the first rear edge; a second wire member is coupled to the bottom surface of the first base member, wherein the second wire member is disposed adjacent to the first front edge; a shape of the second wire member is substantially identical to a shape of the first front edge.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION OF THE PRESENT INVENTION

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

The phrase "artificial hair," as used herein, refers to synthetic hair products as well as human hair or animal hair and combinations thereof. The artificial hair may be embodied in various traditional hair colors, such as black, brown, blonde, and red, as well as non-traditional hair colors, such as blue, green, and purple, and combinations thereof, including individual strands of hair having two or more colors.

The term "user," as used herein, refers to any purchaser of the wig configured according to any of the embodiments disclosed herein, including, but not limited to, individual members of the public, wholesale distributors, retail merchants, manufacturers, importers and exporters of the wig and related components of the wig.

Reference to individual embodiments, whether by number of embodiment or relevant feature of the embodiment, is used for convenience in describing such embodiments. Moreover, reference to individual embodiments does not indicate that any of such embodiments are preferred over any other embodiments. Furthermore, each individual embodiment may be combined with any other individual embodiment whether or not expressly stated.

Embodiments of the invention described herein provide a hair extension apparatus that is coupled to a user's natural hair. The hair extension apparatus includes various components configured to securely couple the hair extension apparatus to the user's natural hair, while also providing a desirable and fashionable appearance.

Figure 1:
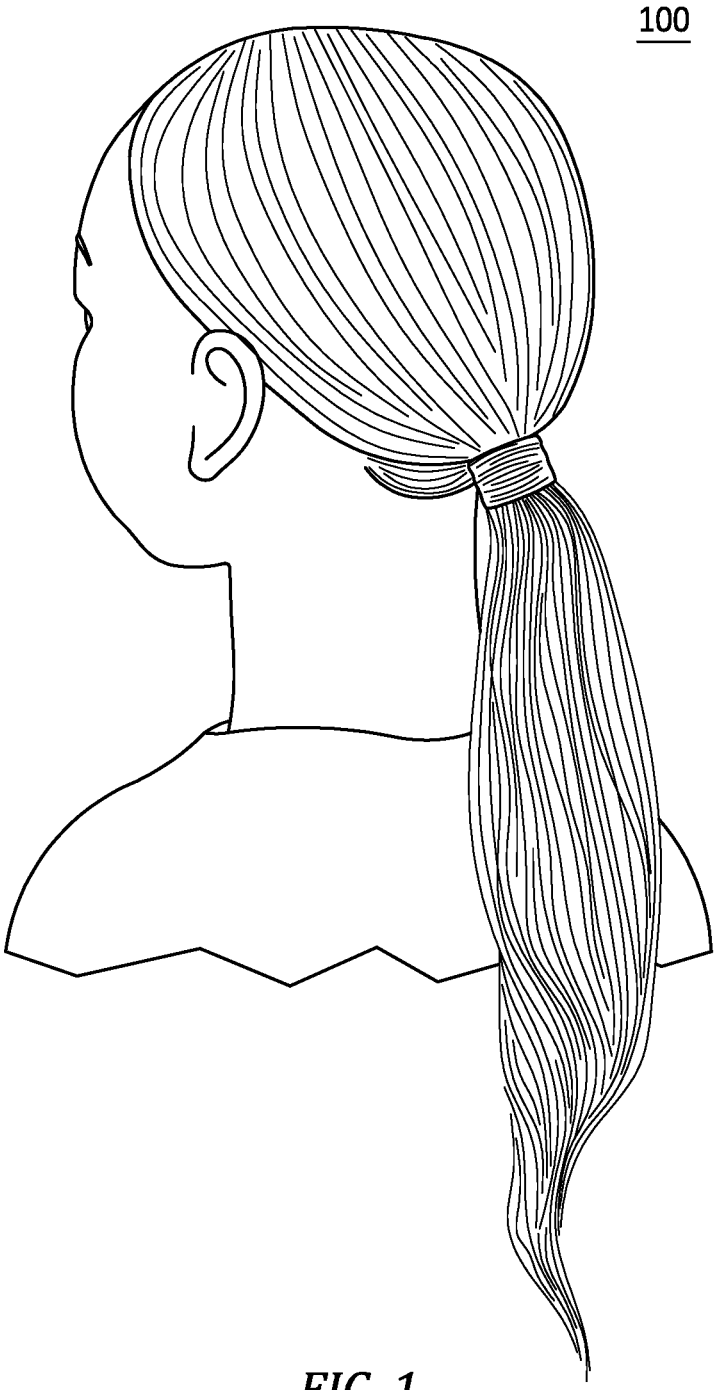
FIG. 1 illustrates a rear perspective view of a hair extension apparatus worn by a user, according to an embodiment of the invention.

FIG. 1 illustrates a rear perspective view of a hair extension apparatus 100 worn by a user, according to an embodiment of the invention. The hair extension apparatus 100 couples to the user's natural hair, as further described herein, providing the user with desirable and natural appearing long hair.

Figure 2:
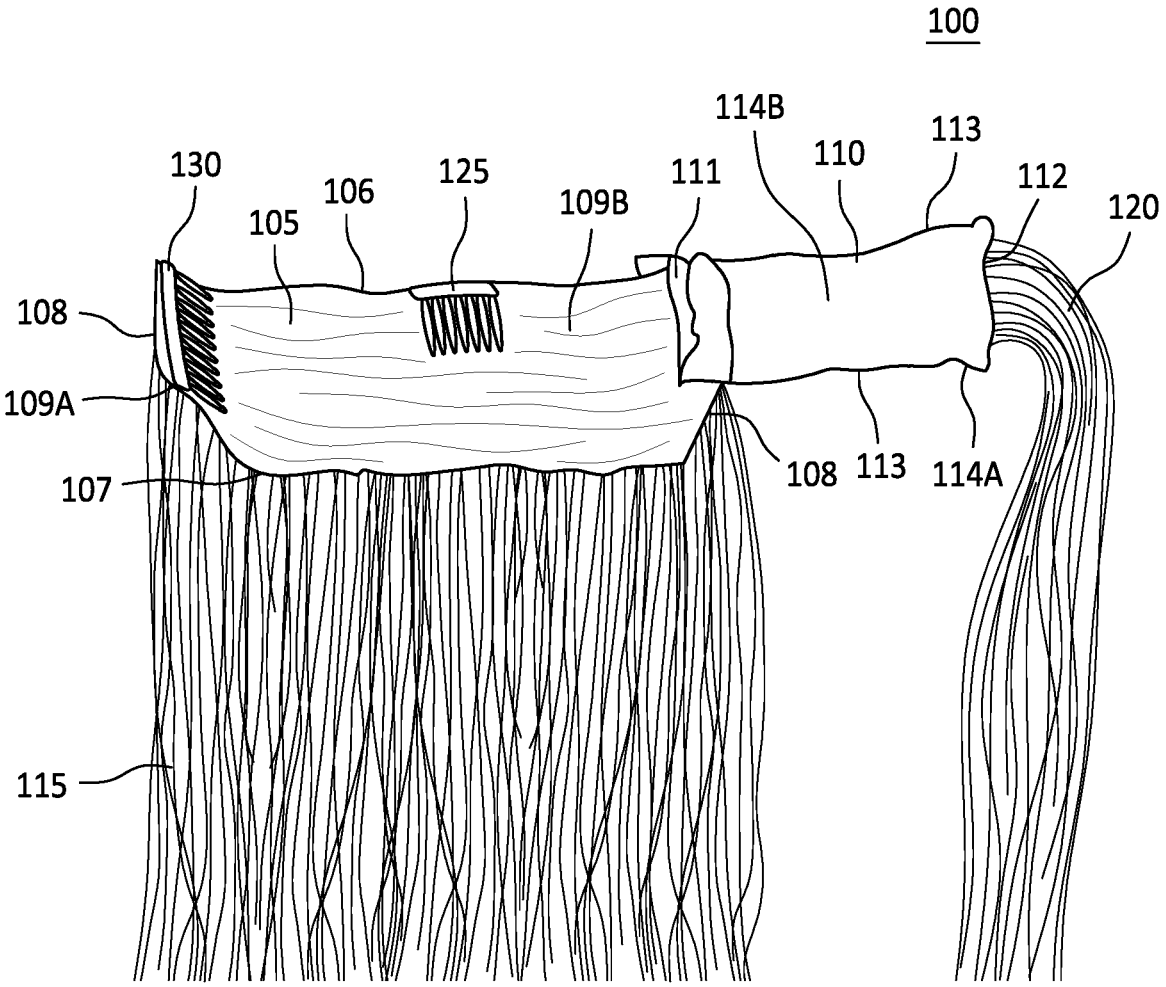
FIG. 2 illustrates a bottom view of the hair extension apparatus, disengaged from the user's hair and in an open configuration for purposes of illustration.
Figure 3:
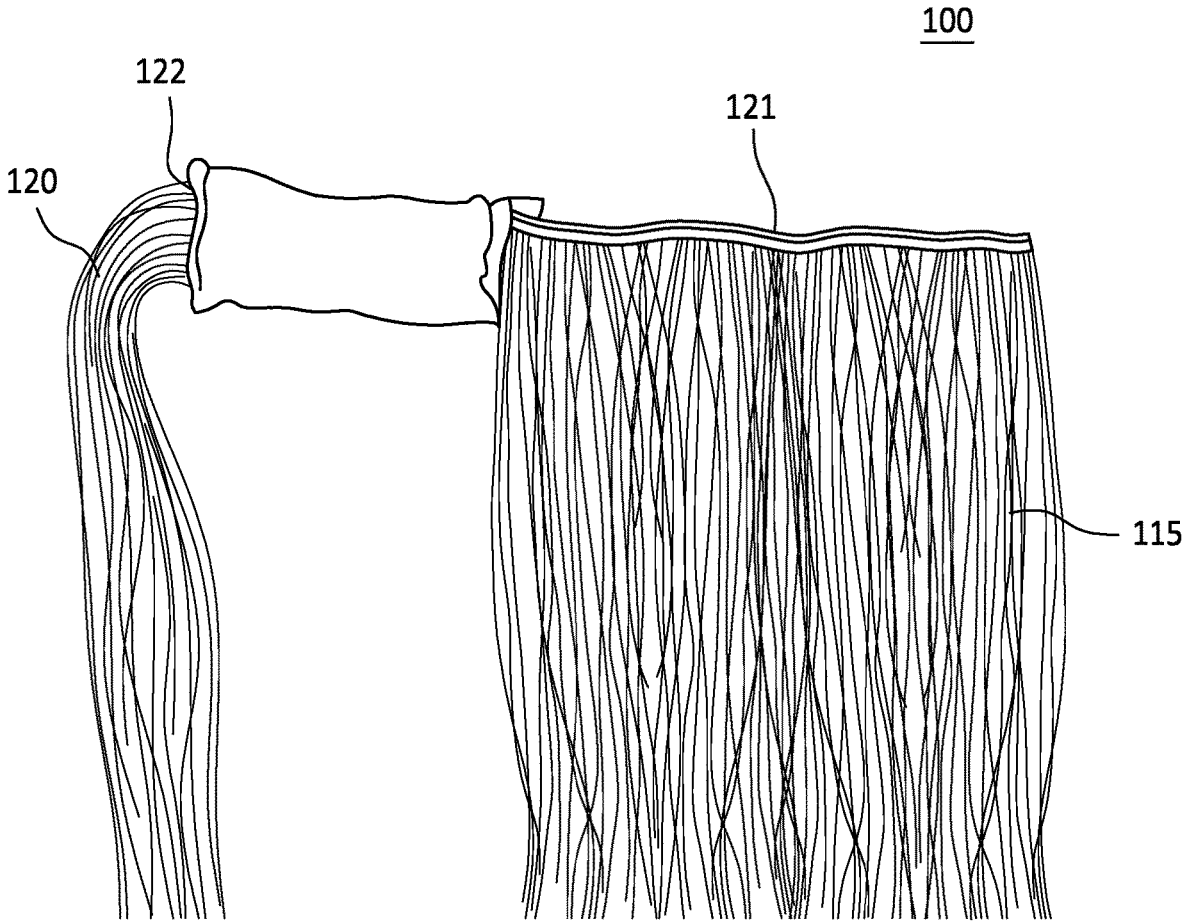
FIG. 3 illustrates a top view of the hair extension apparatus, also disengaged from the user's hair and in an open configuration.

FIG. 2 illustrates a bottom view of the hair extension apparatus 100, disengaged from the user's hair and in an open configuration for purposes of illustration. FIG. 3 illustrates a top view of the hair extension apparatus 100, also disengaged from the user's hair and in an open configuration. The hair extension apparatus 100 includes a first base member 105, a second base member 110, a first artificial hair section 115, a second artificial hair section 120, a first fastener member 125, and a second fastener member 130.

The first base member 105 includes a first front edge 106, a first rear edge 107, a first side edge 108, a first top surface 109A and a first bottom surface 109B. The first base member 105 is constructed of a fine mesh. In certain embodiments, the first base member 105 is constructed of silk mesh, cotton mesh, nylon mesh or other suitable material and combinations thereof. The first artificial hair section 115 is coupled to the first top surface 109A of the first base member 105. It is noted that in certain embodiments, the first artificial hair section 115 can be constructed of various materials, including human hair, animal hair and synthetic hair, and combinations thereof. The first artificial hair section 115 can be curly, straight, or other suitable texture.

In certain embodiments, the first artificial hair section 115 includes individual strands of artificial hair coupled to a first filament section 121. The first filament section 121 is coupled to the first top surface 109A of the base member 105. The "filament" refers to a cylindrical strip of material, e.g., string, constructed of cotton, nylon, or other suitable material, and is coupled to the top surface 109A of the first base member 105 in multiple rows. In certain embodiments, the first filament section 121 is coupled to the first base member 105 in at least five rows, about five to fifteen rows, or about 10 rows, though the number of rows is not limited and can be adjusted according to individual needs and applications. The first filament section 121 may be coupled to the first base member 105 in multiple separate rows in which the first filament section 121 includes multiple separate sections of material. In certain embodiments, the first filament section 121 includes one section of material that is coupled to the first base member 105. In certain embodiments, the first filament section 121 includes one section of material that is coupled to the first base member 105 in a serpentine manner. In certain embodiments, there is sufficient artificial hair in the first artificial hair section 115 to cover the entire surface of the first base member 105.

The second base member 110 includes a second front edge 111, a second rear edge 112, a second side edge 113, a second top surface 114A and a second bottom surface 114B. The second base member 110 is constructed of a fine mesh. In certain embodiments, the second base member 110 is constructed of silk mesh, cotton mesh, nylon mesh or other suitable material and combinations thereof. In certain embodiments, the second base member 110 is constructed of an elastic material such as, for example, stocking material. In certain embodiments, the first base member 105 and the second base member 110 are constructed of the same material. In certain embodiments, the first base member 105 and the second base member 110 are constructed of different types of materials. The second artificial hair section 120 is coupled to the second top surface 114A of the second base member 110. It is noted that in certain embodiments, the second artificial hair section 120 can be constructed of various materials, including human hair, animal hair and synthetic hair, and combinations thereof. The second artificial hair section 120 can be curly, straight, or other suitable texture.

In certain embodiments, the first top surface 109A has a greater surface area than the second top surface 114A. In other words, the first top surface 109A is larger in size than the second top surface 114A.

In certain embodiments, the first front edge 106 is substantially perpendicular to the second front edge 111. That is, as illustrated in FIG. 2, the first front edge 106 is substantially a straight line and the second front edge 111 is substantially a straight line. Thus, the straight line formed by the first front edge 106 is substantially perpendicular to the straight line formed by the second front edge 111. It is noted that, in certain embodiments, the first front edge 106 and the second front edge 111 may be embodied as a curved line or a line with one or more angles.

In certain embodiments, the first rear edge 107 is substantially perpendicular to the second rear edge 112. That is, as illustrated in FIG. 2, the first rear edge 107 is substantially a straight line and the second rear edge 112 is substantially a straight line. Thus, the straight line formed by the first rear edge 107 is substantially perpendicular to the straight line formed by the second rear edge 112. It is noted that, in certain embodiments, the first rear edge 107 and the second rear edge 112 may be embodied as a curved line or a line with one or more angles.

It is noted that where the first front edge 106 is substantially perpendicular to the second front edge 111, the first rear edge 107 may also be substantially perpendicular to the second rear edge 112, though it is not required. In certain embodiments, the first front edge 106 is substantially perpendicular to the second front edge 111 and the first rear edge 107 is not substantially perpendicular to the second rear edge 112. In certain embodiments, the first front edge 106 is not substantially perpendicular to the second front edge 111 and the first rear edge 107 is substantially perpendicular to the second rear edge 112.

In certain embodiments, the artificial hair of the first artificial hair section 115 extends at least partially beyond the first rear edge 107. That is, the artificial hair of the first artificial hair section 115 is of a sufficient length to extend at least partially beyond the first rear edge 107. In certain embodiments, the artificial hair of the second artificial hair section 120 extends at least partially beyond the second rear edge 112. That is, the artificial hair of the second artificial hair section 120 is of a sufficient length to extend at least partially beyond the second rear edge 112.

In certain embodiments, the second base member 110 is coupled to the left side of the first base member 105 or the right side of the first base member 105.

In certain embodiments, the second base member 110 is coupled to both the left side and the right side of the first base member 105. When the second base member 110 is coupled to both the left side and the right side of the first base member 105, one of the second base members is coupled the first base member 105 off-set to the other second base member. That is, one of the second base members is coupled to the first base member 105 closer to the first front edge 106 and the other second base member is coupled to the first base member 105 closer to the first rear edge 107. In this configuration, the two second base members do not overlap when they are wrapped around the first base member 105.

In certain embodiments, the second artificial hair section 120 includes individual strands of artificial hair coupled to a second filament section 122. The second filament section 122 is coupled to the second base member 110. The "filament" refers to a cylindrical strip of material, e.g., string, constructed of cotton, nylon, or other suitable material, coupled to the top surface 114A of the second base member 110 in multiple rows. In certain embodiments, the second filament section 122 is coupled to the second base member 110 in at least one row, about two to ten rows, or about five rows, though the number of rows is not limited and can be adjusted according to individual needs and applications. The second filament section 122 may be coupled to the second base member 110 in multiple separate rows in which the second filament section 122 includes multiple separate sections of material. In certain embodiments, the second filament section 122 includes one section of material that is coupled to the second base member 110 in a serpentine manner.

In certain embodiments, there is sufficient artificial hair in the second artificial hair section 120 to cover the entire surface of the second base member 110. In certain embodiments, there is insufficient artificial hair in the second artificial hair section 120 to cover the entire surface of the second base member 110. In other words, the artificial hair of the second artificial hair section 120 partially covers the surface of the second base member 110, with a portion of the surface of the second base member 110 being free of artificial hair.

The second base member 110 is coupled to the first base member 105. In certain embodiments, the second base member 110 is sewn, glued, or otherwise attached in a non-removable manner to the first base member 105. The top surface of the second base member 110 contacts the bottom surface of the first base member 105 at the location where second base member 110 is coupled to the first base member 105. The top surface of the second base member 110 refers to the surface upon which the second artificial hair section 120 is coupled. The top surface of the first base member 105 refers to the surface upon which the first artificial hair section 115 is coupled.

In certain embodiments, when the hair extension apparatus 100 is in the open configuration, the second base member 110 is coupled to the first base member 105 in such a manner that artificial hair of the first artificial hair section 115 is disposed adjacent to the artificial hair of the second artificial hair section 120. In other words, the artificial hair of the first artificial hair section 115 is coupled to the first base member 105, and the artificial hair of the second artificial hair section 120 is coupled to the second base member 110, in such a manner that that the artificial hair of the first artificial hair section 115 extends in a direction perpendicular to a direction in which the artificial hair of the second artificial hair section 120 extends.

The first fastener member 125 and the second fastener member 130 are coupled to the bottom surface of the first base member 105. The first fastener member 125 is coupled to the first front edge 106. The second fastener member 130 is coupled to the first side edge 108 on the side opposite to the second base member 110. In certain embodiments, the first fastener member 125 and the second fastener member 130 are combs, clips, pins, or other suitable device configured to secure the hair extension apparatus 100 to the user's natural hair. In certain embodiments, the first fastener member 125 and the second fastener member 130 are combs that include tines. The tines of the first fastener member 125 are disposed adjacent to the tines of the second fastener member 130.

In FIG. 2, the first fastener member 125 and the second fastener member 130 are illustrated as being parallel to the edge of the first base member 105. In certain embodiments, the first fastener member 125 and the second fastener member 130 are coupled to the first base member 105 perpendicular to the edge thereof. In certain embodiments, the first fastener member 125 and the second fastener member 130 are coupled to the first base member 105 at an angle greater than or less than perpendicular to the edge thereof.

The hair extension apparatus 100 is used by a user by first wrapping the first base member 105 around their natural hair, with the bottom surface of the first base member 105 being in contact with the user's natural hair. The user's natural hair can be styled in, for example, a bun or a pony tail. When the first base member 105 is fully wrapped around the user's natural hair, the second base member 110 is wrapped around the first base member 105, with the bottom surface of the second base member 110 being in contact with the first base member 105 and/or the first artificial hair section 115. The second artificial hair section 120 is then wrapped around the second base member 110. In this manner, the user is able to couple the hair extension apparatus to their natural hair and obtain the style illustrated in FIG. 1.

In other words, in certain embodiments, the first base member 105 is configured to wrap around a user's natural hair, with the bottom surface 109B of the first base member 105 being in contact with the user's natural hair. In certain embodiments, the second base member 110 is configured to wrap around the first base member 105, with the bottom surface 114B of the second base member 110 being in contact with the first artificial hair section 115.

Figure 4:
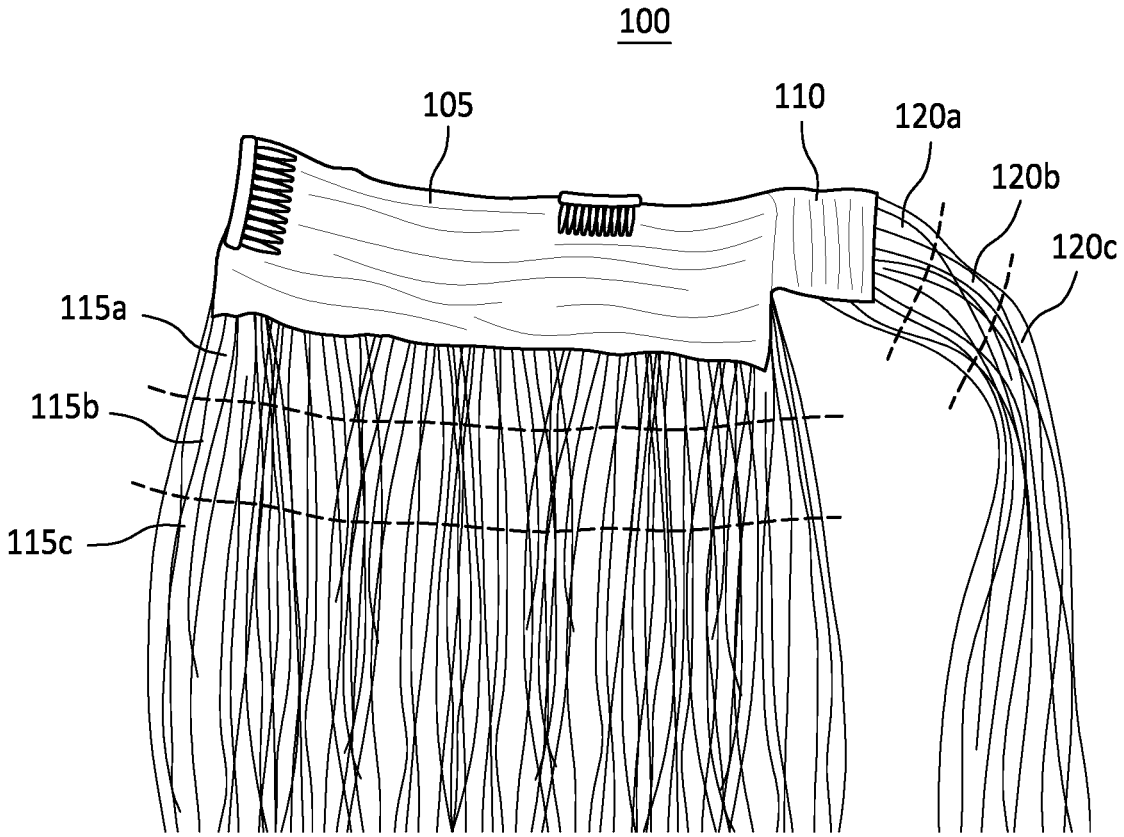
FIG. 4 illustrates a bottom view of the hair extension apparatus, disengaged from the user's hair and in an open configuration, for purposes of illustration, according to an alternative embodiment.
Figure 5:
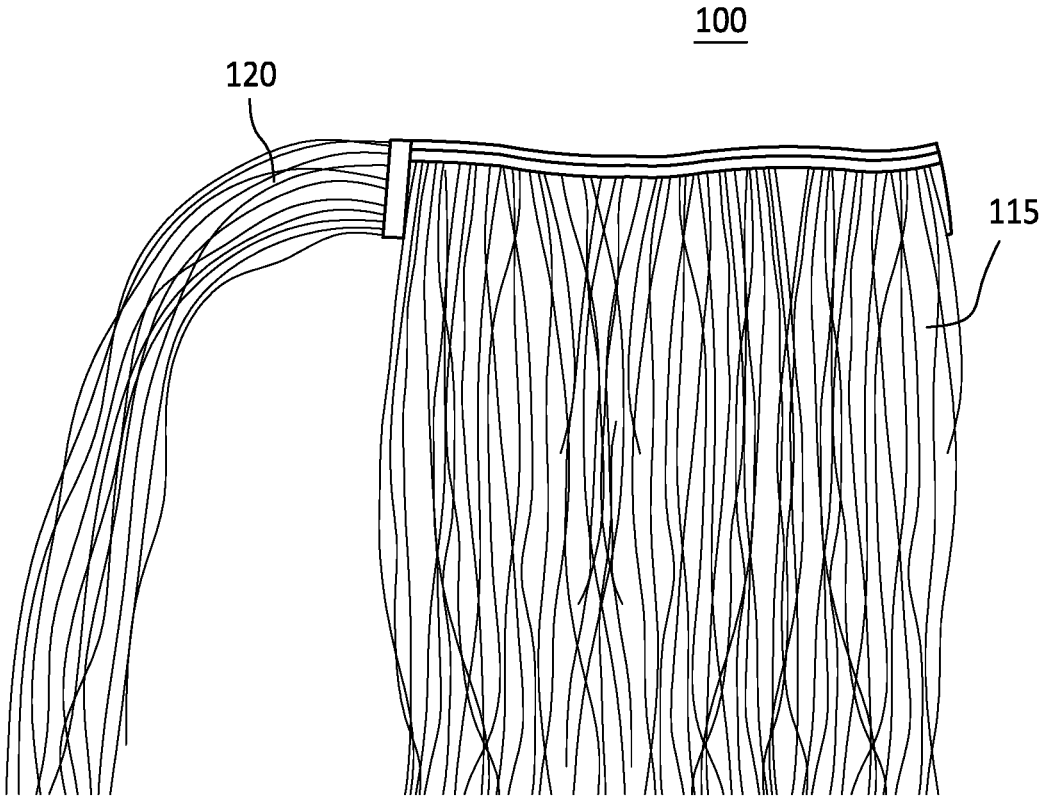
FIG. 5 illustrates a top view of the hair extension apparatus, also disengaged from the user's hair and in an open configuration.

FIG. 4 illustrates a bottom view of the hair extension apparatus 100, disengaged from the user's hair and in an open configuration, for purposes of illustration, in an alternative embodiment of the artificial hair of the first artificial hair section 115 and the artificial hair of the second artificial hair section 120. FIG. 5 illustrates a top view of the hair extension apparatus 100, also disengaged from the user's hair and in an open configuration.

In the embodiment illustrated in FIGS. 4 and 5, the first artificial hair section 115 includes a first color section 115*a*, a second color section 115*b*, and a third color section 115*c*. The first color section 115*a* is the portion of the first artificial hair section 115 that is coupled to the first base member 105. In certain embodiments, the first color section 115*a*, the second color section 115*b*, and the third color section 115*c* are different colors of artificial hair. In the embodiment illustrated in FIGS. 4 and 5, the second color section 115*b* is a blend of the colors of the first color section 115*a* and the third color section 115*c* in which the color of the first color section 115*a* gradually transitions to the color of the third color section 115*c*.

The second artificial hair section 120 includes a fourth color section 120*a*, a fifth color section 120*b*, and a sixth color section 120*c*. The fourth color section 120*a* is the portion of the second artificial hair section 120 that is coupled to the second base member 110. In certain embodiments, the fourth color section 120*a*, the fifth color section 120*b*, and the sixth color section 120*c* are different colors of artificial hair. In the embodiment illustrated in FIGS. 4 and 5, the fifth color section 120*b* is a blend of the colors of the fourth color section 120*a* and the sixth color section 120*c* in which the color of the fourth color section 120*a* gradually transitions to the color of the sixth color section 120*c*.

In certain embodiments, each of the first color section 115*a*, the second color section 115*b*, the third color section 115*c*, the fourth color section 120*a*, the fifth color section 120*b*, and the sixth color section 120*c* are different colors of artificial hair. In certain embodiments, the first color section 115*a* is the same color as the fourth color section 120*a*, the second color section 115*a* is the same color as the fifth color section 120*b*, and the third color section 115*c* is the same color as the sixth color section 120*c*.

In certain embodiments, the first color section 115*a* is substantially the same color as the fourth color section 120*a*, the second color section 115*b* is substantially the same color as the fifth color section 120*b*, and the third color section 115*c* is substantially the same color as the sixth color section 120*c*.

Figure 6:
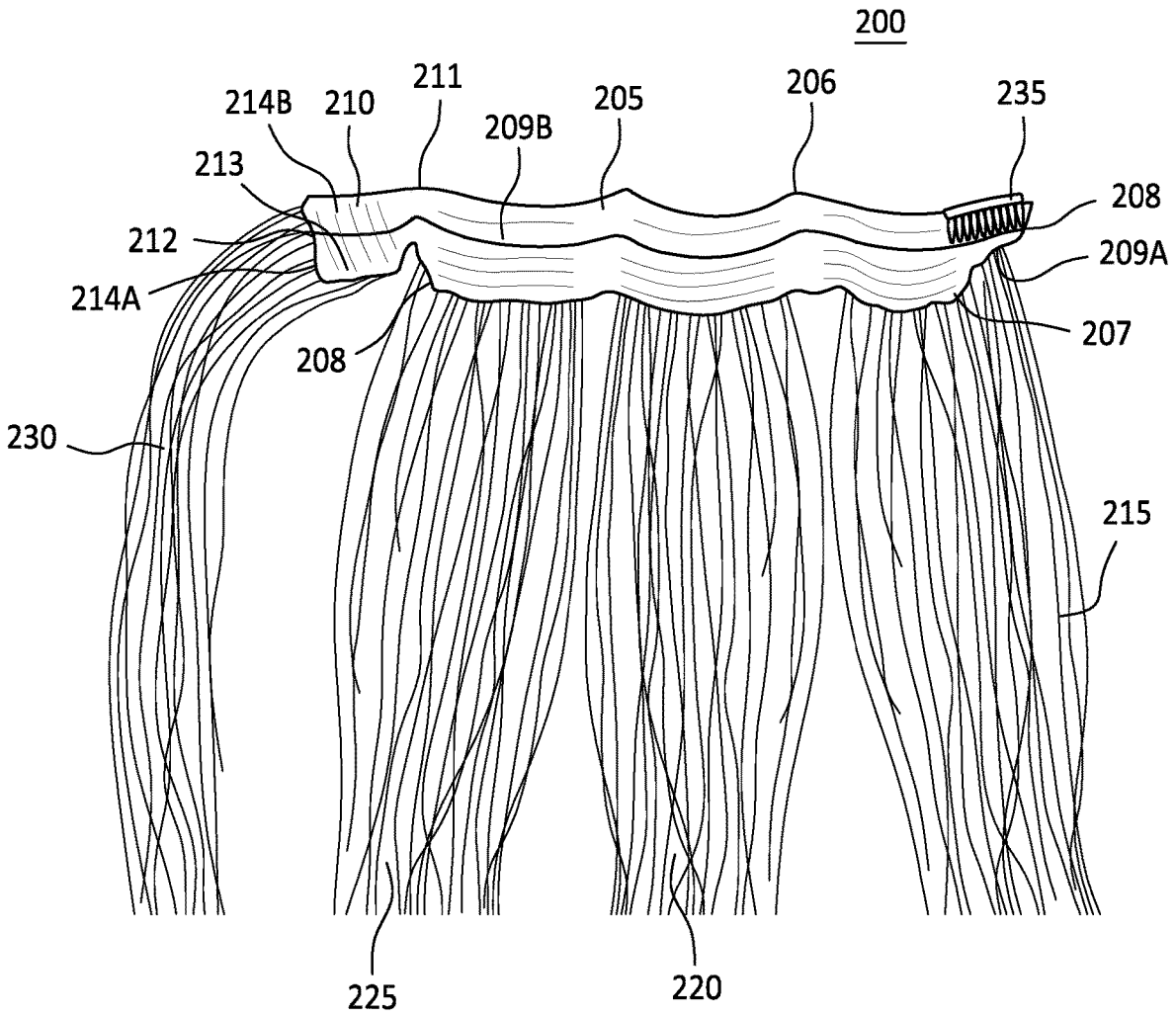
FIG. 6 illustrates a bottom view of a hair extension apparatus, disengaged from the user's hair and in an open configuration, for purposes of illustration, according to an alternative embodiment.
Figure 7:
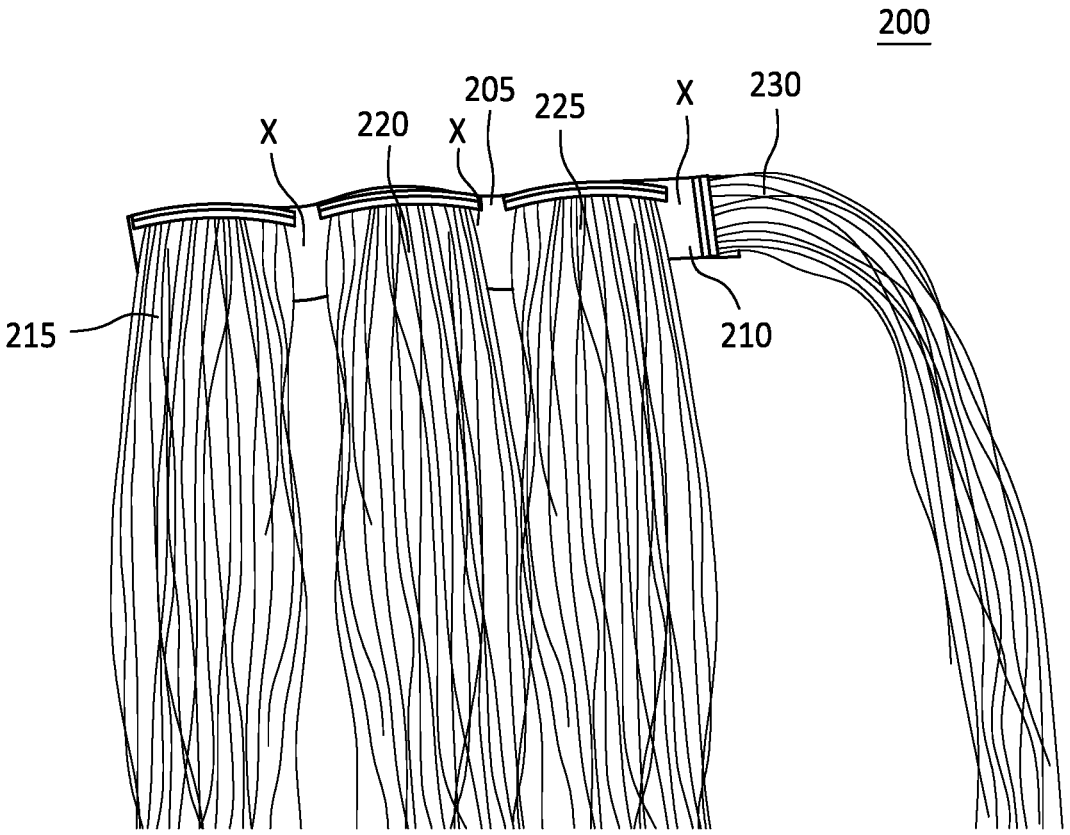
FIG. 7 illustrates a top view of the hair extension apparatus, also disengaged from the user's hair and in an open configuration.

FIG. 6 illustrates a bottom view of a hair extension apparatus 200, disengaged from the user's hair and in an open configuration, for purposes of illustration, in an alternative embodiment. FIG. 7 illustrates a top view of the hair extension apparatus 200, also disengaged from the user's hair and in an open configuration. The hair extension apparatus 200 includes a first base member 205, a second base member 210, a first artificial hair section 215, a second artificial hair section 220, a third artificial hair section 225, a fourth artificial hair section 230, and a fastener member 235.

The first base member 205 includes a first front edge 206, a first rear edge 207, a first side edge 208, a first top surface 209A and a first bottom surface 209B. The first base member 205 is constructed of an elastic material. In certain embodiments, the first base member 205 is constructed of stocking material, silk mesh, cotton mesh, nylon mesh or other suitable material and combinations thereof. The first artificial hair section 215, the second artificial hair section 220 and the third artificial hair section 225 are coupled to first top surface 209A of the first base member 205. It is noted that in certain embodiments, the first artificial hair section 215, the second artificial hair section 220 and the third artificial hair section 225 can be constructed of various materials, including human hair, animal hair and synthetic hair, and combinations thereof. The first artificial hair section 215, the second artificial hair section 220 and the third artificial hair section 225 can be curly, straight, or other suitable texture.

In certain embodiments, the first artificial hair section 215, the second artificial hair section 220 and the third artificial hair section 225 include individual strands of artificial hair coupled to a filament. The filament is coupled to the first base member 205. The filament is a cylindrical strip of material, e.g., string, constructed of cotton, nylon, or other suitable material, and is coupled to the surface of the first base member 205 in multiple rows. In certain embodiments, the filament is coupled to the first base member 205 in at least five rows, about five to fifteen rows, or about 10 rows, though the number of rows is not limited and can be adjusted according to individual needs and applications. The filament may be coupled to the first base member 205 in multiple separate rows in which the filament includes multiple separate sections of material. In certain embodiments, the filament includes one section of material that is coupled to the first base member 205 in a serpentine manner.

The second base member 210 includes a second front edge 211, a second rear edge 212, a second side edge 213, a second top surface 214A and a second bottom surface 214B. The second base member 210 is constructed of an elastic material. In certain embodiments, the second base member 210 is constructed of stocking material, silk mesh, cotton mesh, nylon mesh or other suitable material and combinations thereof. In certain embodiments, the first base member 205 and the second base member 210 are constructed of the same material. In certain embodiments, the first base member 205 and the second base member 210 are constructed on one continuous piece of material. In certain embodiments, the first base member 205 and the second base member 210 are constructed of separate pieces of material. The fourth artificial hair section 230 is coupled to the second top surface 214A of the second base member 210. It is noted that in certain embodiments, the fourth artificial hair section 230 can be constructed of various materials, including human hair, animal hair and synthetic hair, and combinations thereof. The fourth artificial hair section 230 can be curly, straight, or other suitable texture.

In certain embodiments, the fourth artificial hair section 230 includes individual strands of artificial hair coupled to a filament. The filament is coupled to the second base member 210. The filament is a cylindrical strip of material, e.g., string, constructed of cotton, nylon, or other suitable material coupled to the surface of the second base member 210 in multiple rows. In certain embodiments, the filament is coupled to the second base member 210 in at least one row, about two to ten rows, or about five rows, though the number of rows is not limited and can be adjusted according to individual needs and applications. The filament may be coupled to the second base member 210 in multiple separate rows in which the filament includes multiple separate sections of material. In certain embodiments, the filament includes one section of material that is coupled to the second base member 210 in a serpentine manner.

In certain embodiments, there is sufficient artificial hair in the fourth artificial hair section 230 to cover the entire surface of the second base member 210. In certain embodiments, there is insufficient artificial hair in the fourth artificial hair section 230 to cover the entire surface of the second base member 210. In other words, the artificial hair of the fourth artificial hair section 230 partially covers the surface of the second base member 210, with a portion of the surface of the second base member 210 being free of artificial hair.

In certain embodiments, the second base member 210 is coupled to the left side of the first base member 205 or the right side of the first base member 205. In certain embodiments, the second base member 210 is coupled to both the left side and the right side of the first base member 205.

In certain embodiments, the second base member 210 is coupled to the first base member 105. In certain embodiments, the second base member 210 is sewn, glued, or otherwise attached in a non-removable manner to the first base member 205. The top surface of the second base member 210 contacts the bottom surface of the first base member 205. The top surface of the second base member 210 refers to the surface upon which the second artificial hair section 220 is coupled. The bottom surface of the first base member 205 refers to the surface upon which the first artificial hair section 215 is coupled.

In certain embodiments, when the hair extension apparatus 200 is in the open configuration, the second base member 210 is coupled to the first base member 205 in such a manner that artificial hair of the first artificial hair section 215, the second artificial hair section 220 and the third artificial hair section 225 is disposed adjacent to the artificial hair of the fourth artificial hair section 230. In other words, the artificial hair of the first artificial hair section 215, the second artificial hair section 220 and the third artificial hair section 225 extends in a direction perpendicular to a direction in which the artificial hair of the fourth artificial hair section 230 extends. Thus, when the hair extension apparatus 200 is in the closed configuration, the artificial hair of the fourth artificial hair section 230 wraps around the artificial hair of the first artificial hair section 215, the second artificial hair section 220 and the third artificial hair section 225.

The hair extension apparatus 200 is used by a user in a similar manner as described above with respect to the hair extension apparatus 100 to obtain the style illustrated in FIG. 1. However, as illustrated in FIG. 7, there are spaces, denoted by "X", disposed between each of the first artificial hair section 215, the second artificial hair section 220, the third artificial hair section 225, and the fourth artificial hair section 230. The spaces X may be about 0.1 to about 2 inches, or about 1 inch, or about 0.5 inches. Each space "X" is free of artificial hair.

It is noted that although the embodiment illustrated in FIGS. 6 and 7 show three artificial hair sections coupled to the first base member 205, any number of artificial hair sections can be implemented, such as two, three, four, five, and up to ten or more, according to additional embodiments of the invention.

In certain embodiments, the first base member 205 includes a space between at least one of the first artificial hair section 215, the second artificial hair section 220, and the third artificial hair section 225.

In certain embodiments, the space between at least one of the first artificial hair section 215, the second artificial hair section 220, and the third artificial hair section 225 is constructed of an elastic material.

In certain embodiments, the space between at least one of the first artificial hair section 215, the second artificial hair section 220, and the third artificial hair section 225 is free of artificial hair coupled to the first top surface 209A.

In certain embodiments, the first base member 205 includes a space between the third artificial hair section 225 and the fourth artificial hair section 230.

In certain embodiments, there are additional separate sections of artificial hair coupled to the first base member 205. In FIG. 7, three separate sections of artificial hair, the first artificial hair section 215, the second artificial hair section 220, the third artificial hair section 225, are coupled to the first base member 205, however, there can be at least three separate sections of artificial hair, three to ten separate sections of artificial hair, or greater than ten separate sections of artificial hair. In certain embodiments, there are less than three separate sections of artificial hair coupled to the first base member 205. In certain embodiments, there at least two separate sections of artificial hair coupled to the first base member 205.

The spaces X allow for the first base member 205 and the second base member 210 to be stretched. The positions where the first artificial hair section 215, the second artificial hair section 220, the third artificial hair section 225 are coupled to the first base member 205 are somewhat rigid in that the first base member 205 does not easily stretch. Similarly, the position where the fourth artificial hair section 230 is coupled to the second base member 210 is somewhat rigid in that the second base member 210 does not easily stretch. Thus, when the first base member 205 is wrapped around the user's natural hair, the user is able to pull the first base member 205 tighter to their natural hair in those spaced sections. Similarly, when the second base member 210 is wrapped around the user's natural hair, the second base member 210 can be pulled tight around the first base member 205.

The fastener member 235 is coupled to the bottom surface of the first base member 205. In certain embodiments, the fastener member 235 is a comb, clips, pin, or other suitable device configured to secure the hair extension apparatus 200 to the user's natural hair. In FIG. 6, the fastener member 235 is illustrated as being parallel to the edge of the first base member 205. In certain embodiments, the fastener member 235 is coupled to the first base member 205 perpendicular to the edge thereof. In certain embodiments, the fastener member 235 is coupled to the first base member 205 at an angle greater than or less than perpendicular to the edge thereof.

Figure 8:
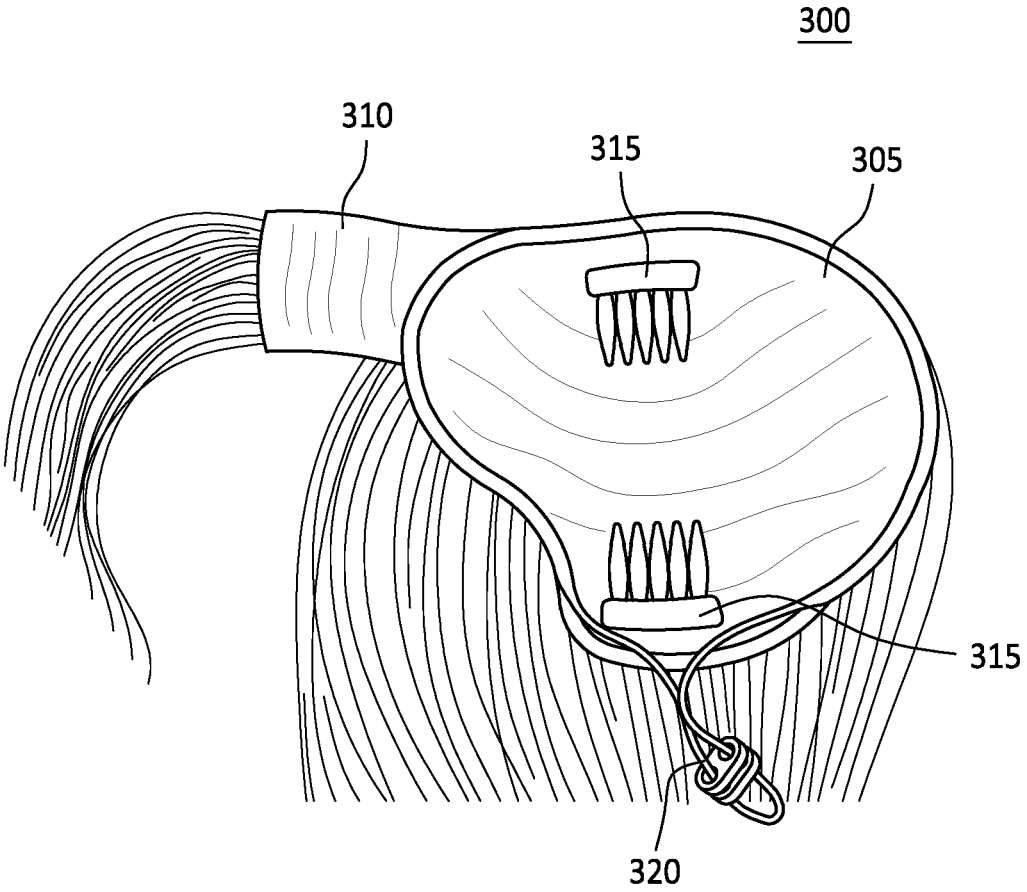
FIGS. 8 and 9 illustrate a bottom view and a top view, respectively, of a hair extension apparatus, according to an alternative embodiment.
Figure 9:
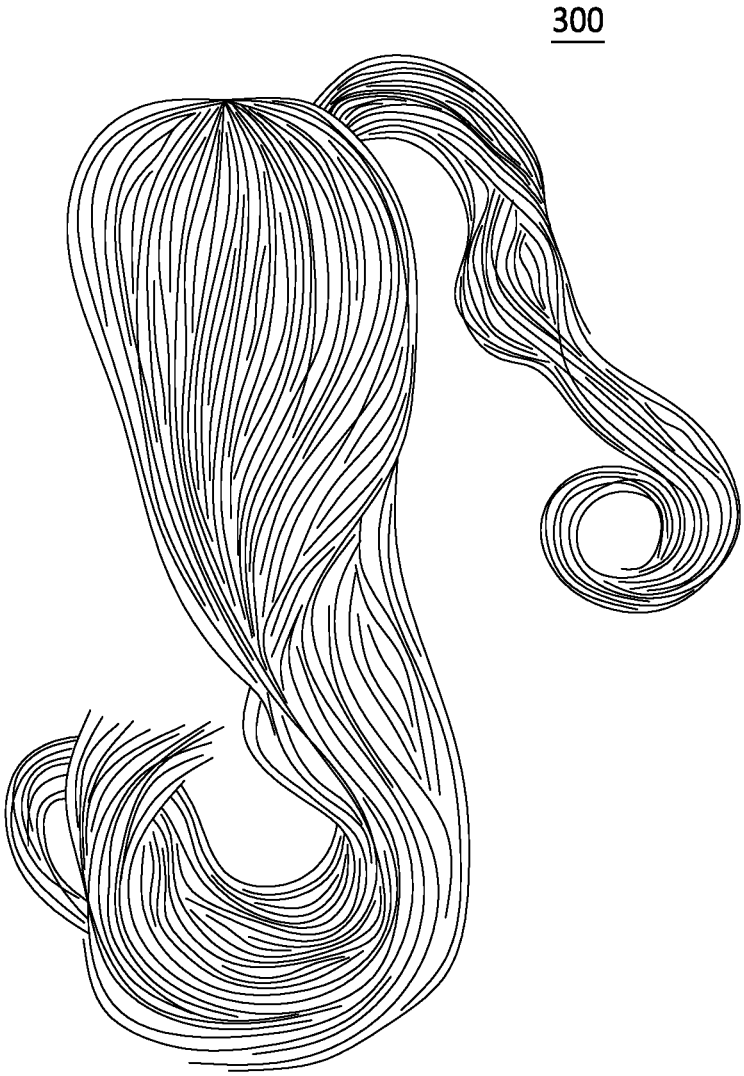

FIGS. 8 and 9 illustrate a bottom view and a top view, respectively, of a hair extension apparatus 300, according to an alternative embodiment. The hair extension apparatus 300 includes a first base member 305, a second base member 310, multiple combs 315, and a drawstring member 320.

The first base member 305 and the second base member 310 are constructed of a mesh material, such as cotton mesh, nylon mesh, or other suitable material and combinations thereof. The color, shape, thickness, flexibility and elasticity of the mesh material can vary according to the particular application. Artificial hair is coupled to the outer surface of the first base member 305 and to the second base member 310. In certain embodiments, the first base member 305 and the second base member 310 are constructed of the same material. In certain embodiments, the first base member 305 and the second base member 310 are constructed of one continuous piece of material. In certain embodiments, the first base member 305 and the second base member 310 are constructed of separate pieces of material.

In certain embodiments, individual strands of artificial hair are coupled to a filament and the filament is coupled to the outer surface of the first base member 305 and the second base member 310. The filament is a cylindrical strip of material, e.g., string, constructed of cotton, nylon, or other suitable material and combinations thereof.

In certain embodiments, the filament is coupled to the first base member 305 and the second base member 310 in at least one row, about two to ten rows, or about five rows, though the number of rows is not limited and can be adjusted according to individual needs and applications. In certain embodiments, the rows are each spaced about 0.1-1.0 inches apart, or about 0.5 inches. The distance between each row may be uniform or the distance between each row may be different. In certain embodiments, the filament coupled to both the first base member 305 and the second base member 310 is one continuous filament. The filament may be coupled to the first base member 305 and the second base member 310 in multiple separate rows in which the filament includes multiple separate sections of material. In certain embodiments, the filament includes one section of material that is coupled separately to the first base member 305 and the second base member 310 in a serpentine manner.

In certain embodiments, there is sufficient artificial hair to cover the entire surface of the first base member 305 and the second base member 310. In certain embodiments, there is insufficient artificial hair in to cover the entire surface of the first base member 305 and the second base member 310. In other words, the artificial hair partially covers the surface of the first base member 305 and the second base member 310, with a portion of the surface of the first base member 305 and the second base member 310 being free of artificial hair.

In certain embodiments, the second base member 310 is coupled to the left side of the first base member 305 or the right side of the first base member 305. In certain embodiments there are multiple of the second base member 310, and at least two of the second base members 310 are coupled to both the left side and the right side of the first base member 305.

The combs 315 are disposed on the inner surface of the first base member 305. The combs 315 are coupled to the inner surface of the first base member 305. In FIG. 8, two of the combs 315 are shown, however, more than two may be implemented and the hair extension apparatus 300 is not limited thereto. The combs 315 include tines that are inserted into the user's hair when the hair extension apparatus 300 is worn by the user. The combs 315 assist with securing the hair extension apparatus 300 to the user's head. The tines of the combs 315 are disposed in opposite directions. In other words, the tines of the combs 315 face each other in a direction towards the center of the first base member 305. In certain embodiments, the tines of the combs 315 face away from each other, towards the outer edge of the first base member 305. In certain embodiments, other devices may be used in place of the combs 315 for securing the hair extension apparatus to the user's hair, such as clips, bobby pins, u-pins or other suitable devices.

The drawstring member 320 is disposed within a sleeve of material around the outer edge of the first base member 305. The drawstring member 320 is a flexible elastic string constructed of, for example, cotton, nylon, or other suitable material and combinations thereof. When the hair extension apparatus 300 is disposed on top of the user's hair, which is configured in, for example, a pony tail or bun, the drawstring member 320 is pulled tight around the user's hair, securing the hair extension apparatus 300 to the user's head. The second base member 310 and the artificial hair coupled to the second base member 310 is wrapped around the user's hair to further secure the hair extension apparatus 300 to the user's hair.

Figure 10:
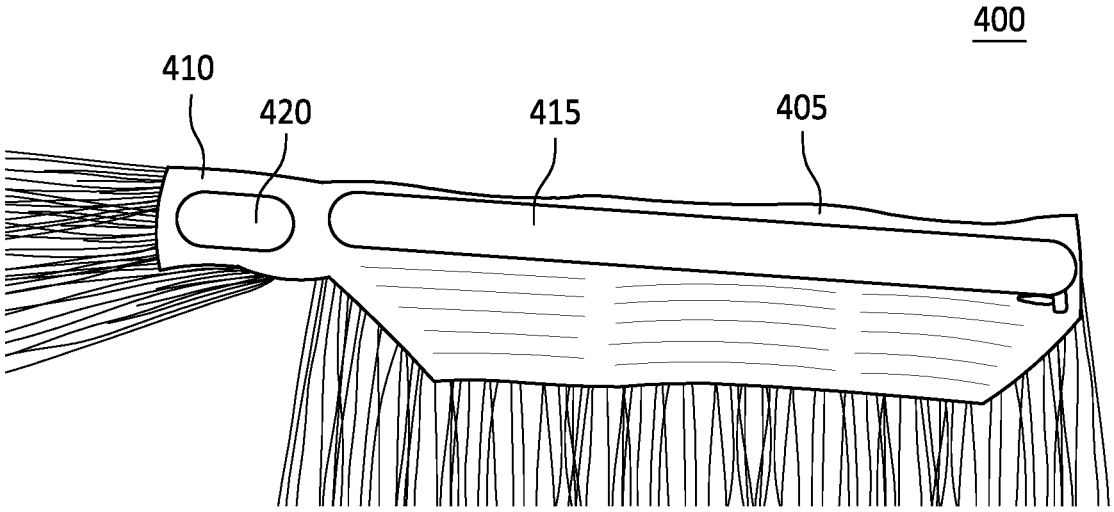
FIGS. 10-12 illustrate a bottom view of a hair extension apparatus including a rubber strip member, according to an alternative embodiment.
Figure 11:
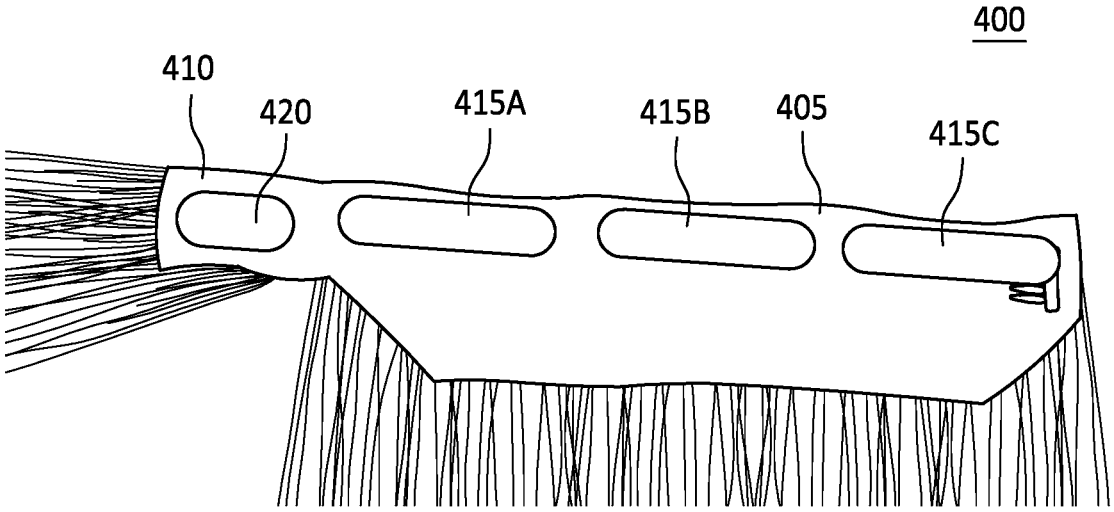
Figure 12:
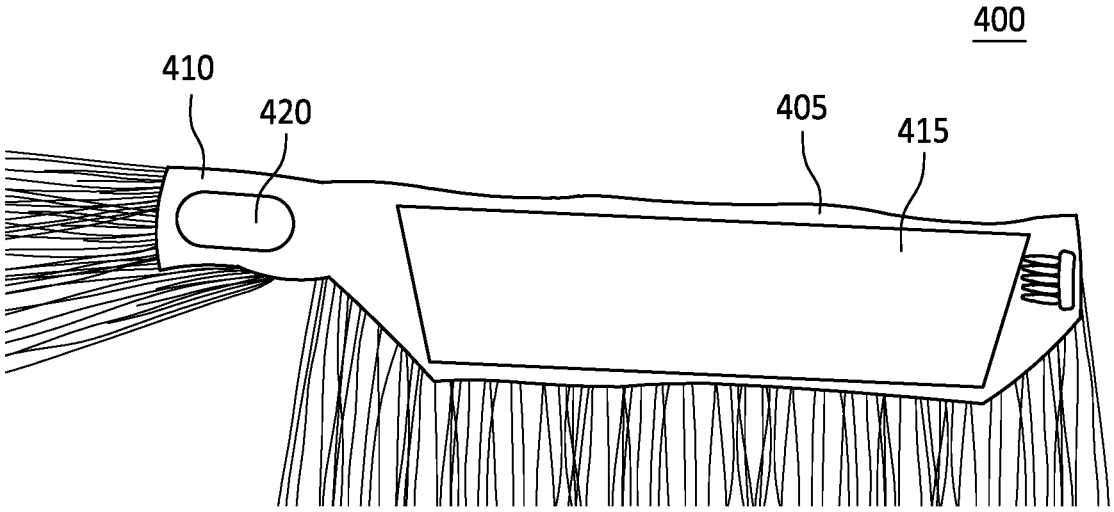

FIGS. 10-12 illustrate a bottom view of a hair extension apparatus 400, according to an alternative embodiment, which can be implemented in each of the above-described embodiments. The hair extension apparatus includes a first base member 405, a second base member 410, a first rubber strip member 415 and a second rubber strip member 420. The first rubber strip member 415 is rigidly attached to the first base member 405. The second rubber strip member 420 is rigidly attached to the second base member 410. The first rubber strip member 415 and the second rubber strip member 420 are constructed of silicone, or other suitable material. The first rubber strip member 415 and the second rubber strip member 420 prevent and/or limit the hair extension apparatus 400 from slipping on the user's head by creating friction between the hair extension apparatus 400 and the user's hair and/or skin.

In FIG. 10, the first rubber strip member 415 extends across the entire width of the first base member 405 up to substantially each edge of the first base member 405 and less than the entire height of the first base member 405. In certain embodiments, the first rubber strip member 415 extends across the first base member 405 less than the entire width. Similarly, the second rubber strip member 420 extends across the entire width of the second base member 410 up to substantially each edge of the second base member 420 and less than the entire height of the second base member 420. In certain embodiments, the second rubber strip member 420 extends across the second base member 410 less than the entire width.

In FIG. 11, the first rubber strip member 415 includes a first rubber strip member 415A, a second rubber strip member 415B and a third rubber strip member 415C. The first rubber strip member 415A, the second rubber strip member 415B and the third rubber strip member 415C extend across the entire width of the first base member 405 with a space between the first rubber strip member 415A and the second rubber strip member 415B and a space between the second rubber strip member 415B and the third rubber strip member 415C. The first rubber strip member 415A is disposed adjacent to one edge of the first base member 405 while the third rubber strip member 415C is disposed adjacent to the opposite edge of the first base member 405, as illustrated. The second rubber strip member 415B is disposed between the first rubber strip member 415A and the third rubber strip member 415C.

In FIG. 12, the first rubber strip member 415 extends across the entire width of the first base member 405 up to each edge of the first base member 405 as well as the entire height of the first base member 405. That is, the rubber strip member 415 is configured in a shape substantially corresponding to the shape of the first base member 405. The second rubber strip member 420 extends across the entire width of the second base member 410 up to each edge of the second base member 410 as well as the entire height of the second base member 410. That is, the second rubber strip member 420 is configured in a shape substantially corresponding to the shape of the second base member 410.

As illustrated in FIGS. 10-12 and provided in the corresponding description, the first rubber strip member 415 and the second rubber strip member 420 can vary in shape, material, size, number and placement of rubber strips according to the embodiments thereof.

In certain embodiments, the first base member 405 is configured to wrap around a user's natural hair with the first rubber strip member 415 of the first base member 405 being in contact with the user's natural hair. In certain embodiments, the second base member 410 is configured to wrap around the first base member 405 with the second rubber strip member 420 of the second base member 410 being in contact with the artificial hair coupled to the first base member 405.

In certain embodiments, the first rubber strip member 415 extends across the width of the first base member 405 up to substantially each of the first side edges of the first base member 405 and less than the entire height of the first base member 405.

In certain embodiments, the first rubber strip member 415 extends across the first base member 405 a distance less than the entire width.

In certain embodiments, the second rubber strip member 420 extends across the width of the second base member 410 up to substantially each of the second side edges of the second base member and less than the height of the second base member 410.

In certain embodiments, the second rubber strip member 420 extends across the second base member 410 a distance less than the entire width.

In certain embodiments, the first rubber strip member 415 comprises multiple first rubber strip members, and at least two of the first rubber strip members comprise a space therebetween.

In certain embodiments, the first rubber strip member 415 is configured in a shape substantially corresponding to the shape of the first base member 405. In certain embodiments, the second rubber strip member 420 is configured in a shape substantially corresponding to the shape of the second base member 410.

Figure 13:
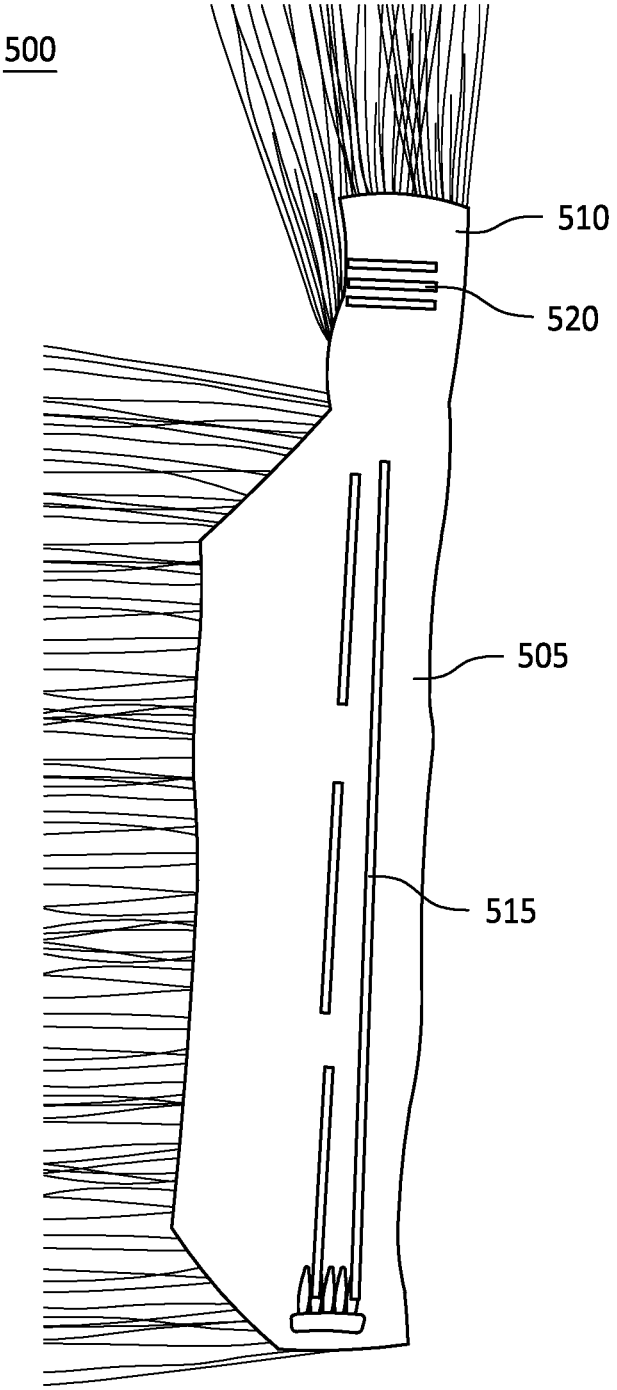
FIGS. 13 and 14 illustrate alternative embodiments of a hair extension apparatus in which a first base member includes a first filament section and a second base member includes a second filament section.
Figure 14:
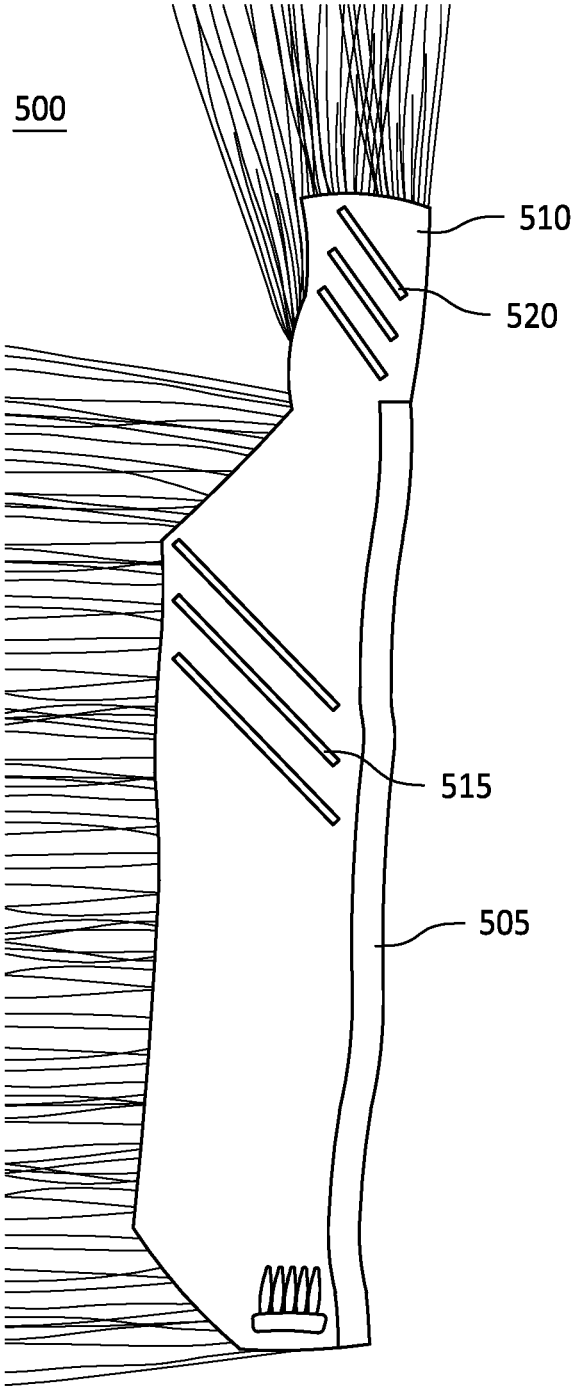

FIGS. 13 and 14 illustrate alternative embodiments, which can be implemented in each of the above-described embodiments, of a hair extension apparatus 500 in which a first base member 505 includes a first filament section 515 and a second base member 510 includes a second filament section 520. In FIGS. 13 and 14, the first filament section 515 and the second filament section 520 are highlighted for purposes of illustration. The first filament section 515 is coupled to the first base member 515. The second filament section 520 is coupled to the second base member 510. As illustrated in FIG. 13, the first filament section 515 is coupled to the first base member 505 in an orientation parallel to the front edge of the first base member 505 and the second filament section 520 is coupled to the second base member 510 in an orientation parallel to the front edge of the second base member 510. As illustrated in FIG. 14, the first filament section 515 is coupled to the first base member 505 in an orientation diagonal to the front edge of the first base member 505 and the second filament section 520 is coupled to the second base member 510 in an orientation diagonal to the front edge of the second base member 510. In certain embodiments, the first filament section 515 and the second filament section 520 are coupled to the first base member 505 and the second base member 510, respectively, in a perpendicular orientation.

In certain embodiments, the first filament section 515 and the second filament section 520 are coupled to the first base member 505 and the second base member 510, respectively, in different directions. For example, the first filament section 515 is coupled to the first base member 505 in a parallel orientation and the second filament section 520 is coupled to the second base member 510 in a perpendicular orientation. For example, the first filament section 515 is coupled to the first base member 505 in a perpendicular orientation and the second filament section 520 is coupled to the second base member 510 in a parallel orientation. For example, the first filament section 515 is coupled to the first base member 505 in a diagonal orientation and the second filament section 520 is coupled to the second base member 510 in a parallel orientation. For example, the first filament section 515 is coupled to the first base member 505 in a parallel orientation and the second filament section 520 is coupled to the second base member 510 in a diagonal orientation. For example, the first filament section 515 is coupled to the first base member 505 in a perpendicular orientation and the second filament section 520 is coupled to the second base member 510 in a diagonal orientation. For example, the first filament section 515 is coupled to the first base member 505 in a diagonal orientation and the second filament section 520 is coupled to the second base member 510 in a perpendicular orientation.

Figure 15:
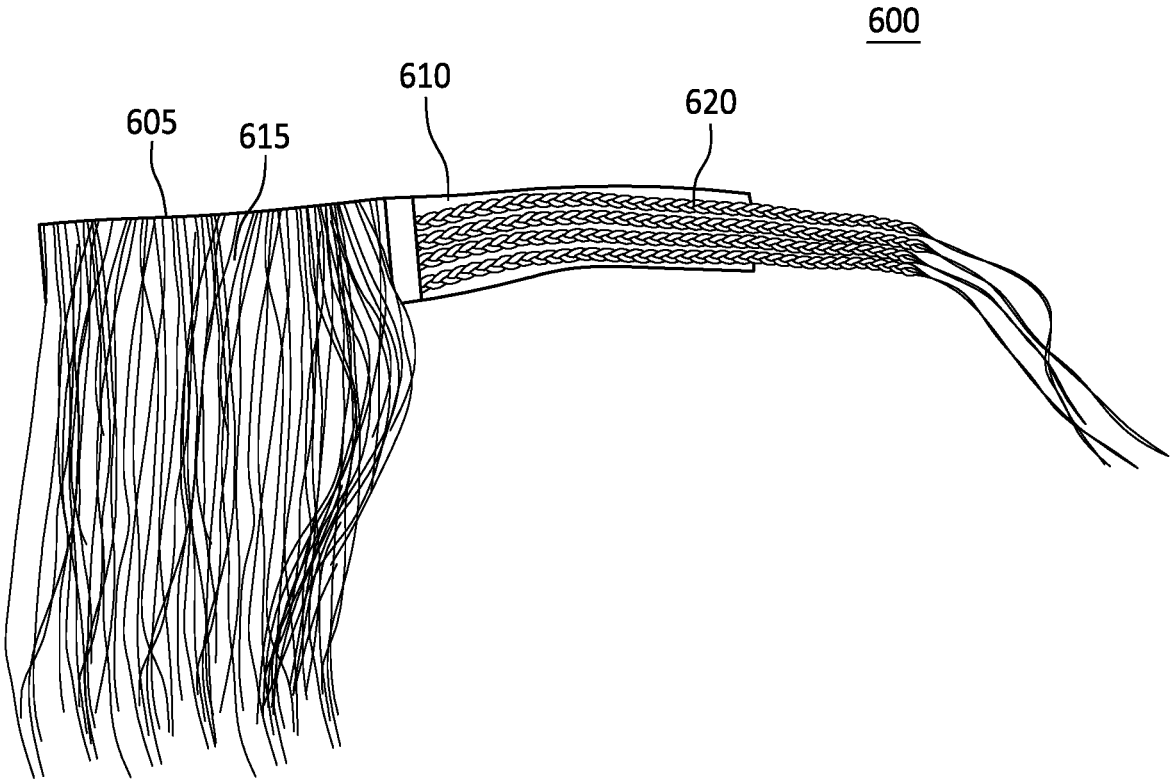
FIGS. 15 and 16 illustrate an alternative embodiment of a hair extension apparatus in which artificial hair coupled to a second base member is braided.
Figure 16:
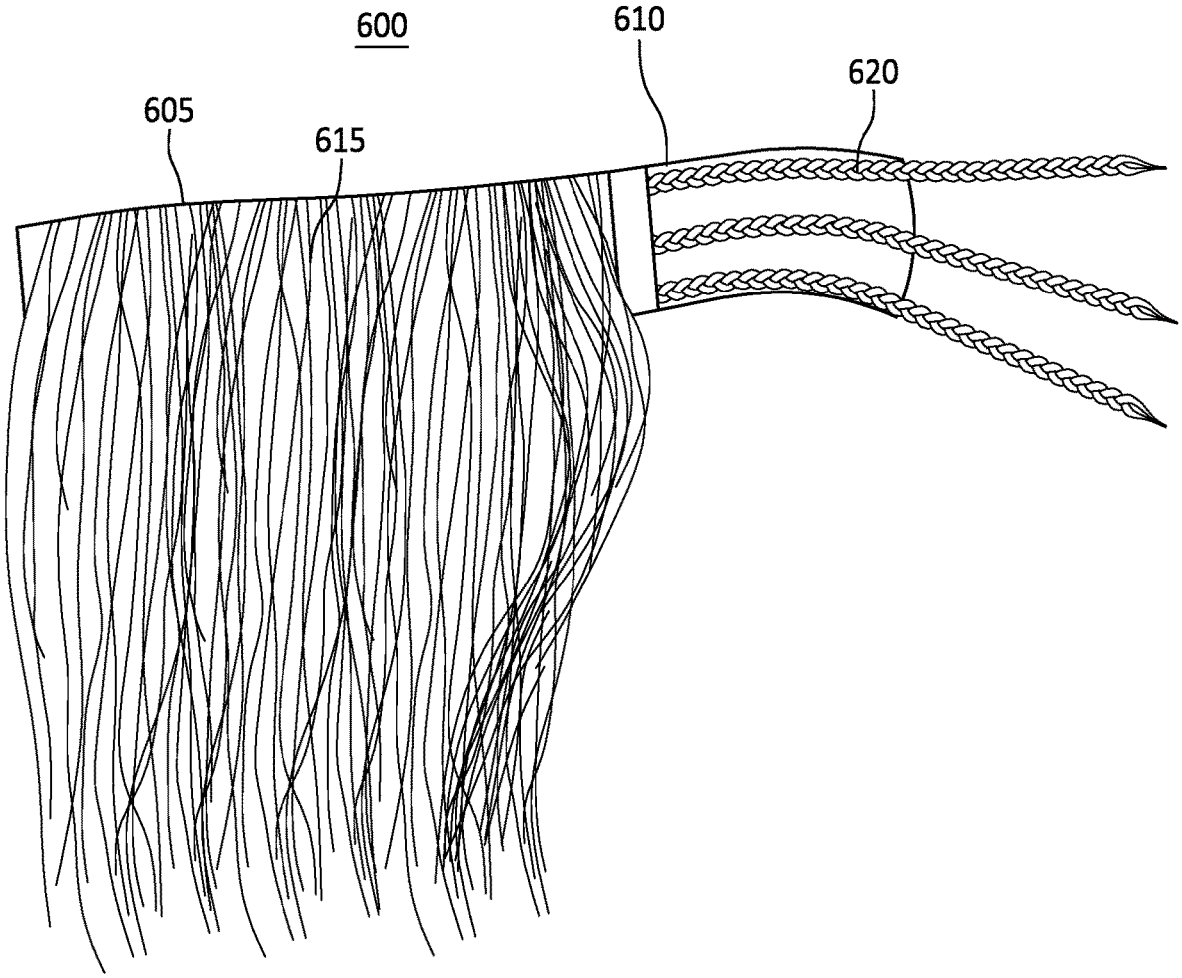

FIGS. 15 and 16 illustrate an alternative embodiment of a hair extension apparatus 600. The hair extension apparatus 600 includes a first base member 605 and a second base member 610. A first artificial hair section 615 is coupled to the first base member 605. A second artificial hair section 620 is coupled to the second base member 610. The artificial hair of the first artificial hair section 615 includes individual strands of artificial hair. The artificial hair of the second artificial hair section 620 includes individual strands of artificial hair. As illustrated in FIG. 15, the artificial hair of the second artificial hair section 620 coupled to the second base member 610 is braided. That is, individual strands of artificial hair coupled to the outer surface of the second base member 610 are braided. As illustrated in FIG. 16, the second artificial hair section 620 is configured as pre-made artificial hair wefts braided into multiple braids that are coupled to the outer surface of the second base member 610. In both embodiments illustrated in FIGS. 15 and 16, the braids of the second hair section 620 are wrapped around the first artificial hair section 615, as described above with respect to the other embodiments. Furthermore, the number, style and thickness of the braids in the second artificial hair section 620 can very according to individual preferences and applications.

Figure 17:
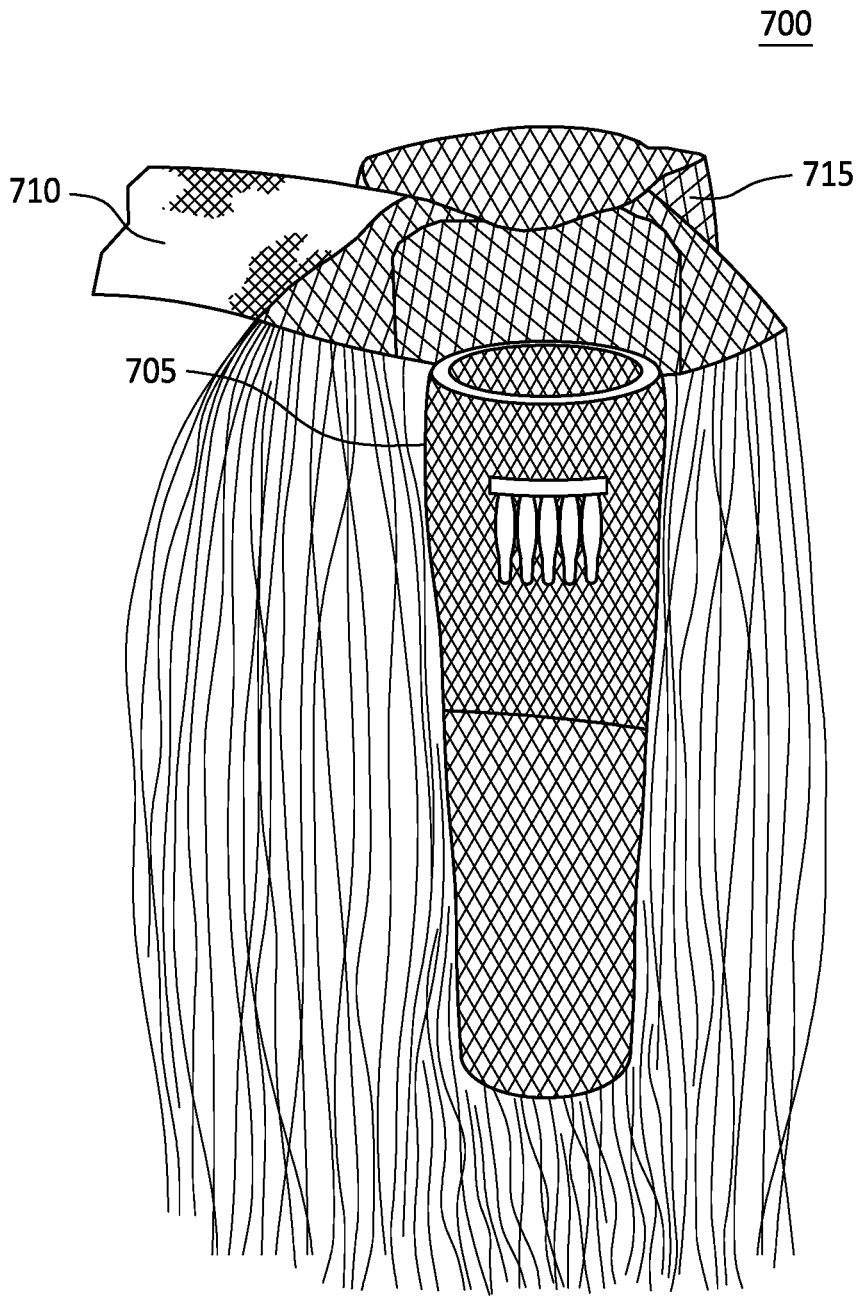
FIG. 17 illustrates an alternative embodiment of the hair extension apparatus.

FIG. 17 illustrates an alternative embodiment of the hair extension apparatus 700. The hair extension apparatus 700 includes a first base member 705, a second base member 710, and a sleeve member 715.

Figure 18:
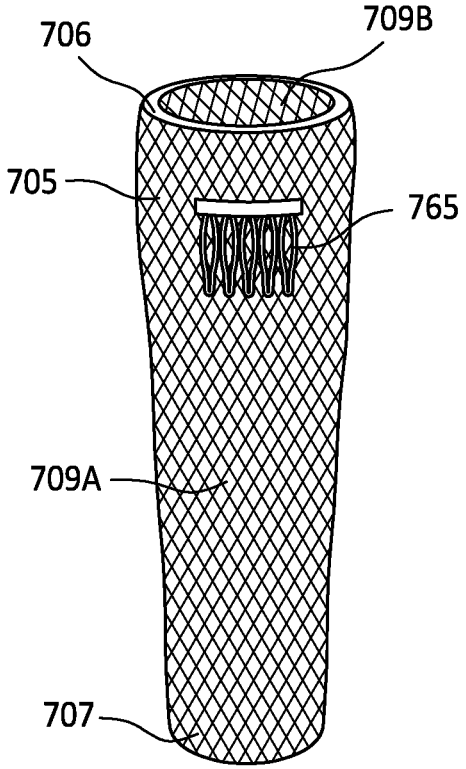
FIG. 18 illustrates a perspective view of the first base member with no artificial hair coupled to a surface thereof.

FIG. 18 illustrates a perspective view of the first base member 705 with no artificial hair coupled to a surface thereof. The first base member 705 includes a first front edge 706, a first rear edge 707, a first top surface 709A and a first bottom surface 709B. The first base member 705 is constructed of a fine mesh. In certain embodiments, the first base member 705 is constructed of silk mesh, cotton mesh, nylon mesh or other suitable material and combinations thereof. In the embodiment illustrated in FIG. 18, the first base member 705 is configured in a cylindrical shape. That is, the first base member 705 is constructed of a continuous piece of mesh material, with both ends of the first base member 705 being open such that the user can pull their ponytail through the interior of the artificial hair apparatus 700. In other words, the user pulls their ponytail first through the opening of the first front edge 706 and out the opening of the first rear edge 707. The first bottom surface 709B faces the interior of the hair extension apparatus 700 and contacts the user's ponytail when the hair extension apparatus 700 is worn by the user. In certain embodiments, a silicone strip is coupled to the first bottom surface 709B. The silicone strip creates friction between the user's hair and the bottom surface 709B the hair extension apparatus 700, securing the hair extension apparatus 700 to the user's hair.

In certain embodiments, the first base member 705 is configured in a conical shape. When the first base member 705 is configured in a conical shape, the opening of the first front edge 706 has a greater circumference than the opening of the first rear edge 707, or, the opening of the first front edge 706 has a circumference smaller than the opening of the first rear edge 707.

In certain embodiments, a first artificial hair section 717 is coupled to the first top surface 709A of the first base member 705. It is noted that in certain embodiments, the first artificial hair section 717 can be constructed of various materials, including human hair, animal hair and synthetic hair, and combinations thereof. The first artificial hair section 717 can be curly, straight, or other suitable texture.

In certain embodiments, a second artificial hair section 718 is coupled to the second top surface 710A of the second base member 710. It is noted that in certain embodiments, the second artificial hair section 718 can be constructed of various materials, including human hair, animal hair and synthetic hair, and combinations thereof. The second artificial hair section 718 can be curly, straight, or other suitable texture.

In certain embodiments, the first artificial hair section 717 and second artificial hair section 718 include individual strands of artificial hair coupled to a filament with the filament being coupled to the first top surface 709A of the first base member 705 and the second top surface 709B of the second base member 710, respectively. The "filament" refers to a cylindrical strip of material, e.g., string, constructed of cotton, nylon, or other suitable material, and is configured similarly as described with respect to the other embodiments. The filament is coupled to the first top surface 709A and the second top surface 709B in multiple rows. In certain embodiments, the filament is coupled to the first base member 705 and the second base member 710 in at least five rows, about five to fifteen rows, or about 10 rows, though the number of rows is not limited and can be adjusted according to individual needs and applications. The filament may be coupled to the first base member 705 and the second base member 710 in multiple separate rows in which the filament includes multiple separate sections of material.

In certain embodiments, there is sufficient artificial hair in the first artificial hair section 716 to cover the entire surface of the first base member 705. In certain embodiments, there is sufficient artificial hair in the second artificial hair section 717 to cover the entire surface of the second base member 710. In certain embodiments, the second artificial hair section 717 covers a portion of the second base member 710 and a portion of the second base member 710 is not covered by the second artificial hair section 717.

In certain embodiments, a third artificial hair section is coupled the second bottom surface 710B of the second base member 710.

Figure 19:
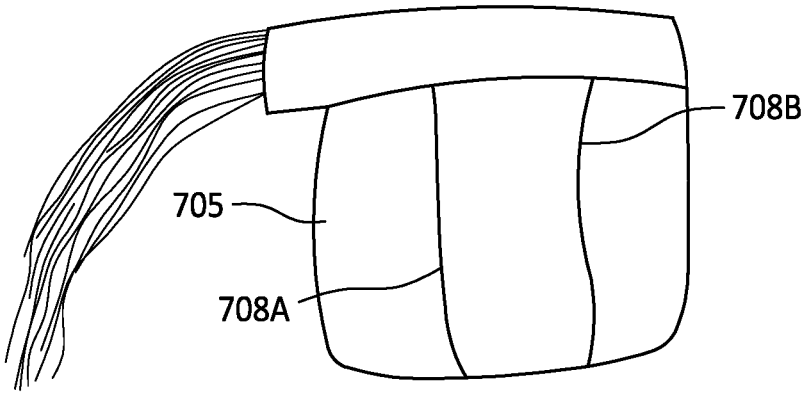
FIG. 19 illustrates the hair extension apparatus according to an alternative embodiment.

FIG. 19 illustrates the hair extension apparatus 700 according to an alternative embodiment. In this embodiment, the first base member 705 includes a first side edge 708A and a second side edge 708B. In this embodiment, the hair extension apparatus 700 is not constructed of a circular piece of mesh material. The hair extension apparatus 700 is configured in a cylindrical or conical shape by coupling the first side edge 708A to the second side edge 708B. In certain embodiments, the first side edge 708A is sewn to the second side edge 708B along a seam. In certain embodiments, the first side edge 708A is coupled to the second side edge 708B using a zipper, glue, hook and loop, or other similar manner of coupling fabric together.

Figure 20:
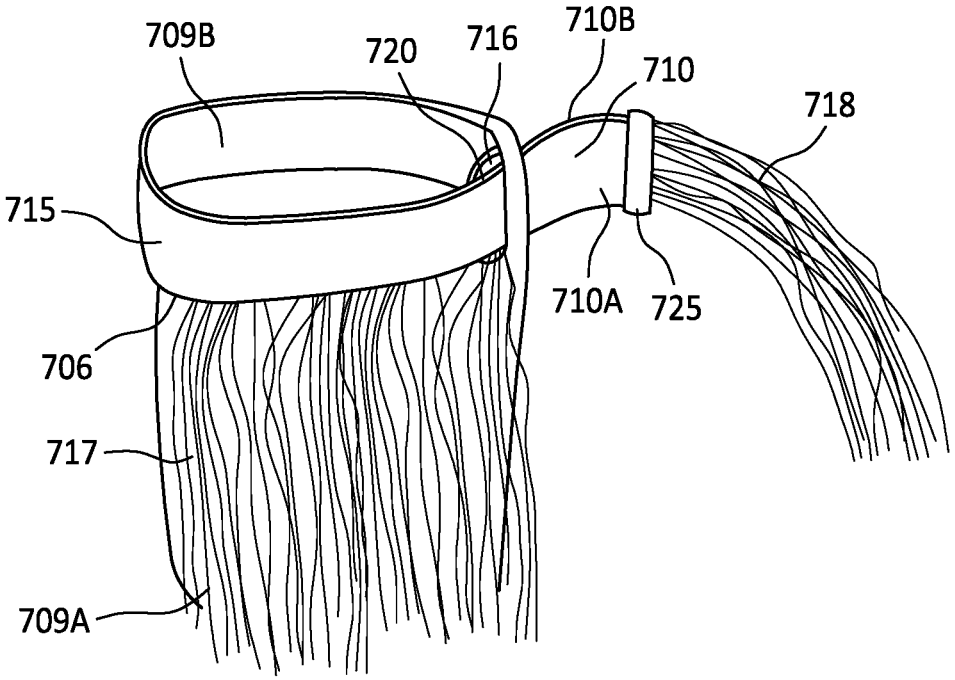
FIG. 20 illustrates the sleeve member of the hair extension apparatus.

FIG. 20 illustrates the sleeve member 715 of the hair extension apparatus 700. The sleeve member 715 is coupled along the first front edge 706. The sleeve member 715 extends along the entire first front edge 706. The sleeve member 715 is constructed of silk mesh, cotton mesh, nylon mesh or other suitable material and combinations thereof. The sleeve member 715 includes a hole 716 in a surface thereof. A portion of the second base member 710 is disposed within the sleeve member 715 and extends through the hole 716. In this embodiment, the second base member 710 includes a first end 720 and a second end 725. The first end 720 of the second base member 710 is coupled to the interior of the sleeve member 715. The second end 725 of the second base member 710 is not within the sleeve member 715. The second base member 710 extends from the position where the first end 720 is coupled to the sleeve member 715, through the interior of the sleeve member 715, and out of the hole 716. Thus, the second end 725 of the second base member 710 can be pulled by the user to tighten the sleeve member 715 around the user's ponytail, providing a tight and secure hold of the hair extension apparatus 700 to the user.

In certain embodiments, a silicone strip is coupled to an interior of the sleeve member 715. The silicone strip creates friction between the user's hair and the sleeve member 715 of the hair extension apparatus 700, securing the hair extension apparatus 700 to the user's hair.

Figure 21:
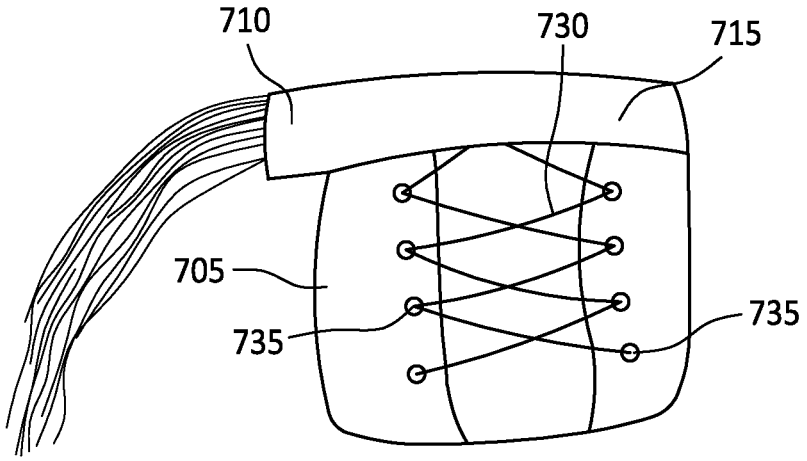
FIG. 21 illustrates an alternative embodiment of the hair extension apparatus.

FIG. 21 illustrates an alternative embodiment of the hair extension apparatus 700. In this embodiment, the hair extension apparatus 700 tightens around the user's ponytail using a "corset" configuration. Specifically, the hair extension apparatus includes a lace 730 and holes 735. The holes 735 run along the first side edge 708A and the second side edge 708B. The first base member 705 is split and has two ends that are brought together by the lace 730 when the lace 730 is tightened. The lace 730 is strung through the holes 735 and secured by, e.g., tying a knot, at one end by the user. The lace 730 is configured to be pulled tight by the user, thus tightening the hair extension apparatus 700 around the user's ponytail.

In certain embodiments, the holes 735 run along the entire length of the first base member 705. For example, there are at least two, four, or eight or more of the holes 735 on each side of the first base member 705. In certain embodiments, the first base member 705 is sewn together halfway and then the lace 730 and holes 735 run the remaining half of the length of the first base member 705. For example, the first base member 705 is sewn from the sleeve member 715 down half the length of the first base member 705 and the holes 735 run along the remaining half of the length of the first base member 705. Alternatively, the first base member 705 is sewn from the end opposite to the sleeve member 715 up half the length of the first base member 705 and the holes 735 run along the remaining half of the length of the first base member 705.

Figure 22:
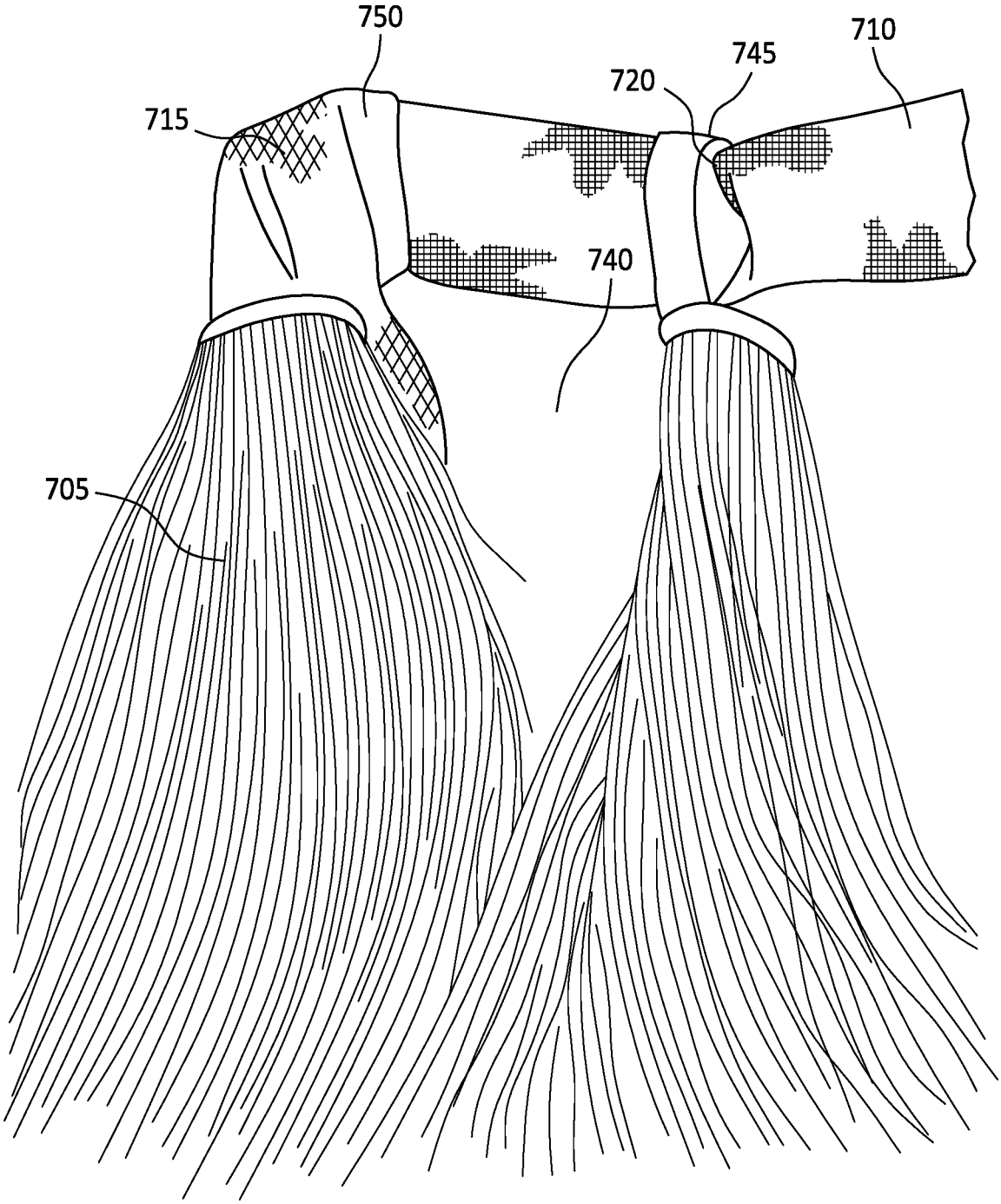
FIGS. 22-24 illustrate an alternative embodiment of the hair extension apparatus.
Figure 23:
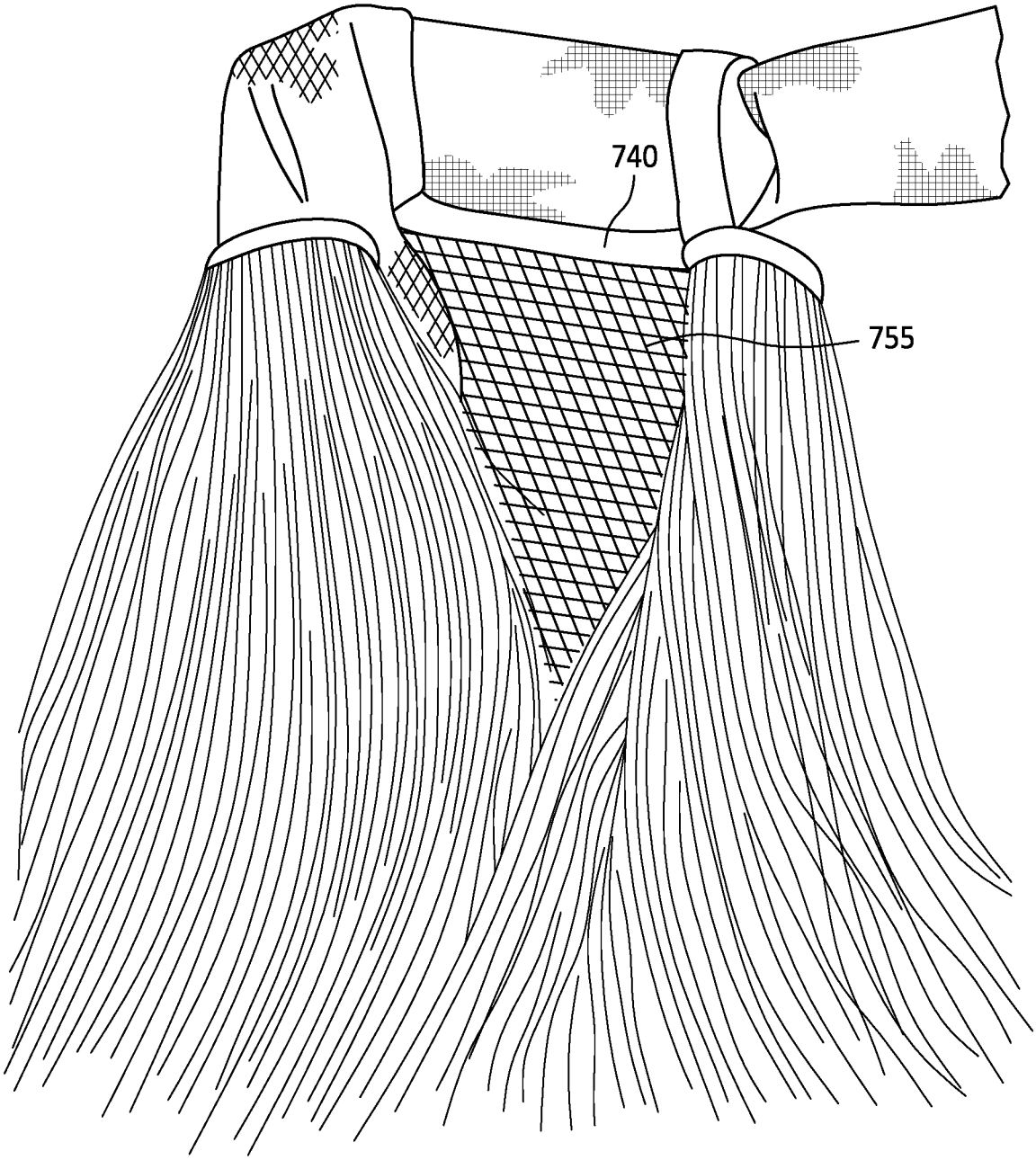
Figure 24:
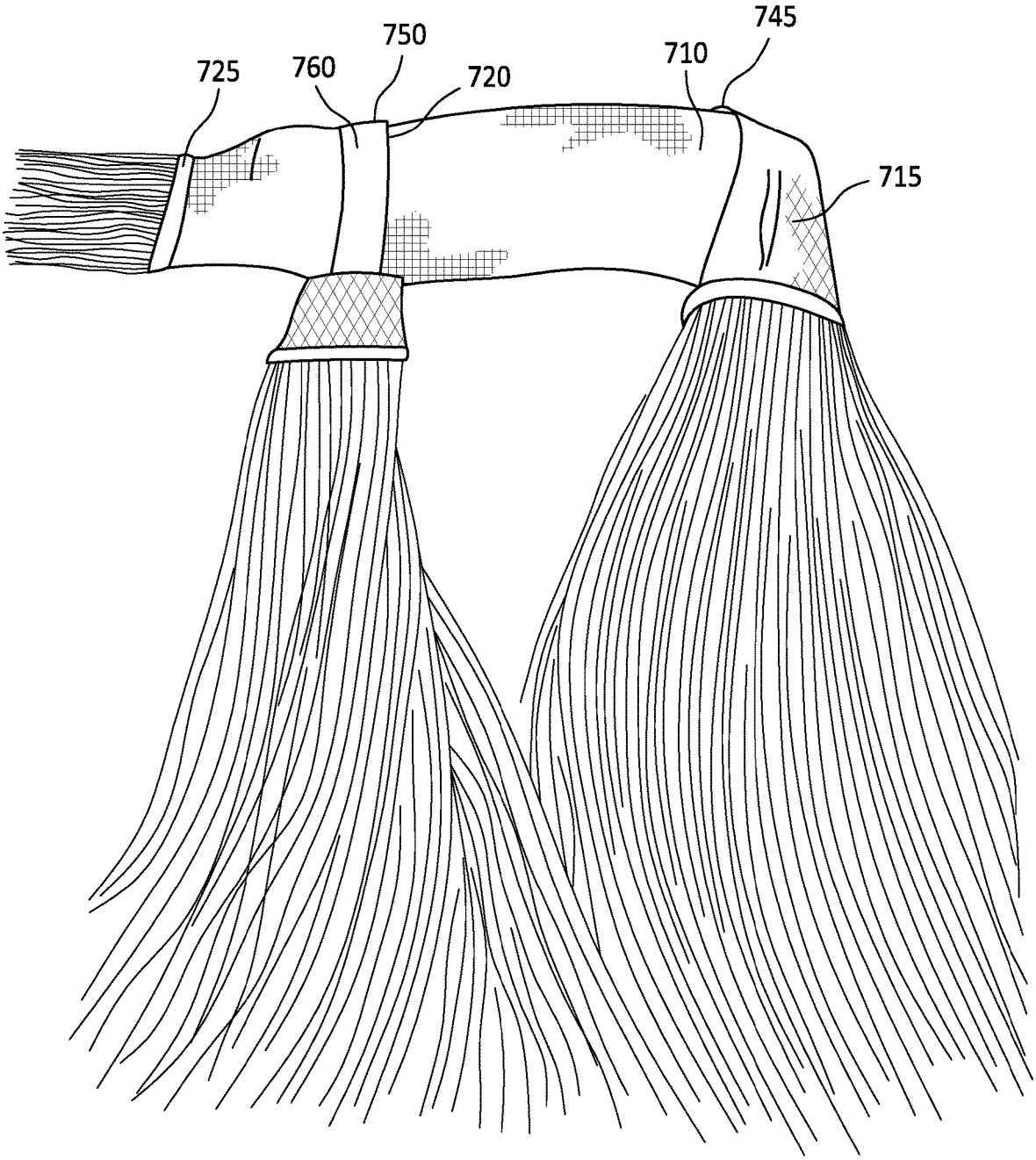

FIGS. 22-24 illustrate an alternative embodiment of the hair extension apparatus 700. As illustrated in FIG. 22, first base member 705 of the hair extension apparatus 700 includes an open region 740. In this embodiment, the first end 720 is coupled to the sleeve member 715 and extends from a first end 745 of the open region 740, across the open region 740, and enters the sleeve member 715 at a second end 750 of the open region 740. The open region 740 leaves space for the user to tighten the second base member 710 through the sleeve member 715 around the user's ponytail without causing the portion of the first base member 705 contacting the user's ponytail to bunch up. The open region 740 is illustrated in FIG. 22 as being configured in a "V" shape, however, in certain embodiments, the open region 740 can be a "U" shape, or any other suitable shape.

In certain embodiments, as illustrated in FIG. 23, the open region 740 includes a mesh portion 755. The mesh portion 755 of the open region extends up to the sleeve member 715. In other words, the mesh portion 755 does not overlap the sleeve member 715. The mesh portion 755 is constructed of stocking material, silk mesh, cotton mesh, nylon mesh or other suitable material and combinations thereof. In certain embodiments, the mesh portion 755 includes artificial crocheted to a surface thereof. In certain embodiments, the mesh portion 755 is free of artificial hair.

In certain embodiments, as illustrated in FIG. 24, the hair extension apparatus 700 includes a loop member 760. In this embodiment, the first end 720 of the second base member 710 is coupled to the sleeve member 715 at the second end 750 of the open region 740. The second base member 710 extends from the second end 750 of the open region 740, through the sleeve member 715, and out of the sleeve member 715 at the first end 745 of the open region 740. From the first end 745 of the open region 740, the second base member 710 extends across the open region 740 and through the loop member 760. The second base member 710 is pulled by the user through the loop member 760 to tighten the sleeve member 715 around the user's ponytail.

In certain embodiments, as illustrated in FIG. 18, the hair extension apparatus includes a fastener member 765 coupled to the first bottom surface 710B of the first base member 705. The fastener member 765 is coupled to the first front edge 706 below the first end 720. In certain embodiments, the fastener member 765 is a comb, clip, pin, or other suitable device configured to secure the hair extension apparatus 700 to the user's natural hair. In certain embodiments, the fastener member 765 is a comb that includes tines. The tines of the fastener member 765 are disposed pointing in a direction away from the first front edge 706 and towards the first rear edge 707.

Figure 25:
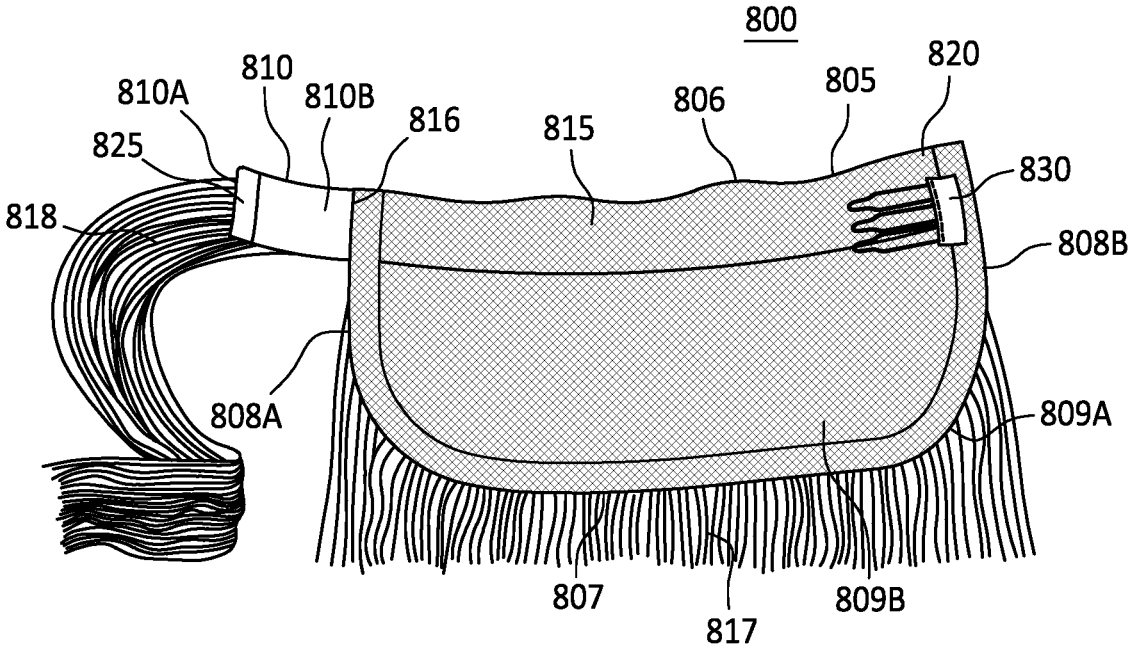
FIG. 25 illustrates a hair extension apparatus, according to an alternative embodiment.

FIG. 25 illustrates a hair extension apparatus 800, according to an alternative embodiment. As illustrated in FIG. 25, the hair extension apparatus 800 includes a first base member 805 and a second base member 810. The first base member 805 includes a sleeve member 815. The first base member 805 includes a first front edge 806, a first rear edge 807, a first top surface 809A and a first bottom surface 809B. The first base member 805 is constructed of a fine mesh. In certain embodiments, the first base member 805 is constructed of silk mesh, cotton mesh, nylon mesh or other suitable material and combinations thereof.

In certain embodiments, a first artificial hair section 817 is coupled to the first top surface 809A of the first base member 805. It is noted that in certain embodiments, the first artificial hair section 817 can be constructed of various materials, including human hair, animal hair and synthetic hair, and combinations thereof. The first artificial hair section 817 can be curly, straight, or other suitable texture.

In certain embodiments, a second artificial hair section 818 is coupled to the second top surface 810A of the second base member 810. It is noted that in certain embodiments, the second artificial hair section 818 can be constructed of various materials, including human hair, animal hair and synthetic hair, and combinations thereof. The second artificial hair section 818 can be curly, straight, or other suitable texture.

In certain embodiments, the first artificial hair section 817 and second artificial hair section 818 include individual strands of artificial hair coupled to a filament with the filament being coupled to the first top surface 809A of the first base member 805 and the second top surface 810A of the second base member 810, respectively. The "filament" refers to a cylindrical strip of material, e.g., string, constructed of cotton, nylon, or other suitable material, and is configured similarly as described with respect to the other embodiments. The filament is coupled to the first top surface 809A and the second top surface 810A in multiple rows. In certain embodiments, the filament is coupled to the first base member 805 and the second base member 810 in at least five rows, about five to fifteen rows, or about 10 rows, though the number of rows is not limited and can be adjusted according to individual needs and applications. The filament may be coupled to the first base member 805 and the second base member 810 in multiple separate rows in which the filament includes multiple separate sections of material.

In certain embodiments, there is sufficient artificial hair in the first artificial hair section 817 to cover the entire surface of the first base member 805. In certain embodiments, there is sufficient artificial hair in the second artificial hair section 818 to cover the entire surface of the second base member 810. In certain embodiments, the second artificial hair section 818 covers a portion of the second base member 810 and a portion of the second base member 810 is not covered by the second artificial hair section 818.

In certain embodiments, a third artificial hair section is coupled the second bottom surface 810B of the second base member 810.

The first base member 805 further includes a first side edge 808A and a second side edge 808B. The first side edge 808A and the second side edge 808B are not coupled together. The sleeve member 815 is coupled to the first base member 805 along the first front edge 806 on the first bottom surface 809B. The sleeve member 815 extends along the entire first front edge 806 and is adjacent to the first side edge 808A and the second side edge 808B, but does not extend around any portion of the first rear edge 807. The sleeve member 815 is constructed of silk mesh, cotton mesh, nylon mesh or other suitable material and combinations thereof. The sleeve member 815 includes a hole 816 in a surface thereof. A portion of the second base member 810 is disposed within the sleeve member 815 and extends through the hole 816. In this embodiment, the second base member 810 includes a first end 820 and a second end 825. The first end 820 of the second base member 810 is coupled to the interior of the sleeve member 815. The second end 825 of the second base member 810 is not within the sleeve member 815. The second base member 810 extends from the position where the first end 820 is coupled to the sleeve member 815, through the interior of the sleeve member 815, and out of the hole 816. In certain embodiments, the hole 816 is adjacent to the first side edge 808A. Thus, the second end 825 of the second base member 810 can be pulled by the user to tighten the sleeve member 815 around the user's ponytail, providing a tight and secure hold of the hair extension apparatus 800 to the user.

The hair extension apparatus 800 further includes a fastener member 830 coupled to the first bottom surface 809B of the first base member 805. The fastener member 830 is coupled to the first front edge 806 overlapping the first end 820 of the second base member 810. In certain embodiments, the fastener member 830 is a comb, clip, pin, or other suitable device configured to secure the hair extension apparatus 800 to the user's natural hair. In certain embodiments, the fastener member 830 is a comb that includes tines. The tines of the fastener member 830 are disposed pointing in a direction away from the second side edge 808B towards the first side edge 808A.

Figure 26:
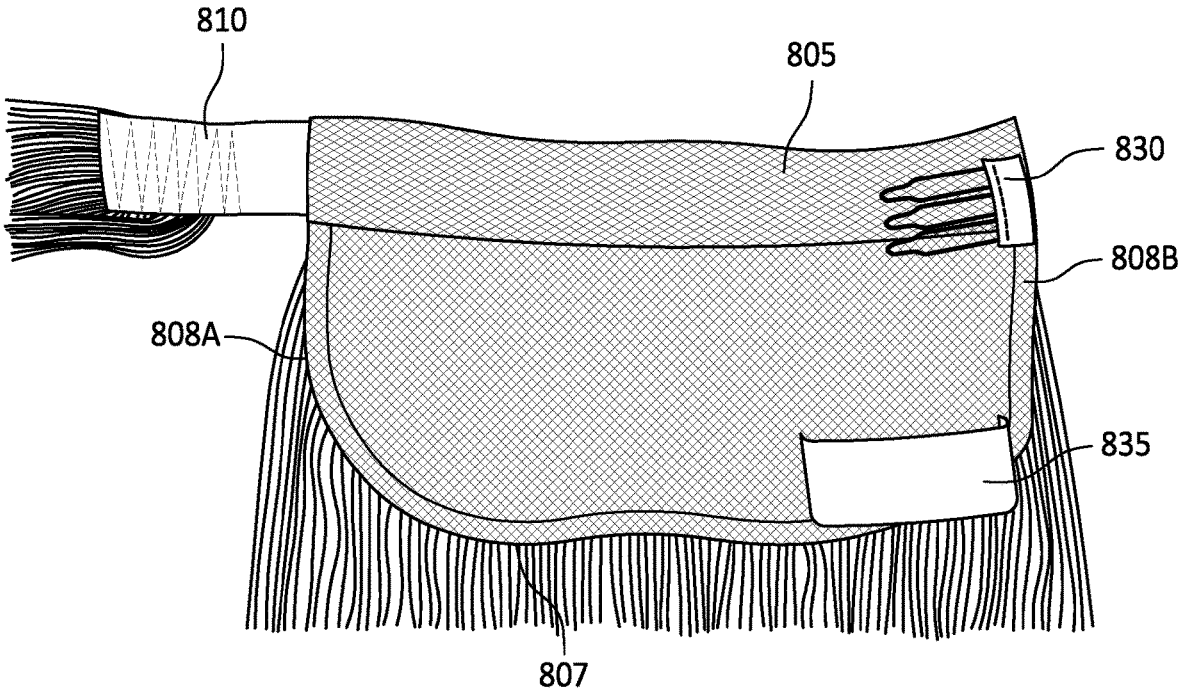
FIG. 26 illustrates the hair extension apparatus including a hair band member.

FIG. 26 illustrates the hair extension apparatus 800 including a hair band member 835. The hair band member 835 is coupled to the bottom surface 809B of the first base member 805. The hair band member 835 is coupled to the bottom surface 809B adjacent to the first rear edge 807 and adjacent to the second side edge 808B. The hair band member 835 is disposed on the same side of the first base member 805 as the fastener member 830. The hair band member 835 is disposed on the opposite side of the first base member 805 as the second base member 810. The hair band member 835 is configured as a loop through which a user can insert their natural hair. In certain embodiments, the hair band member 835 constructed of an elastic material. In certain embodiments, the hair band member 835 is constructed of stocking material, silk, cotton, nylon or other suitable material and combinations thereof. A user of the hair extension apparatus 800 inserts their natural hair, e.g., their ponytail, through the hair band member 835 and then wraps the first base member 805 around their natural hair. The hair band member 835 secures the user's hair to the bottom surface 809B of the first base member 805 on the same side as the fastener member 830. Thus, the hair band member 830 provides an additional component to secure the user's natural hair to the hair extension apparatus 800.

Figure 27:
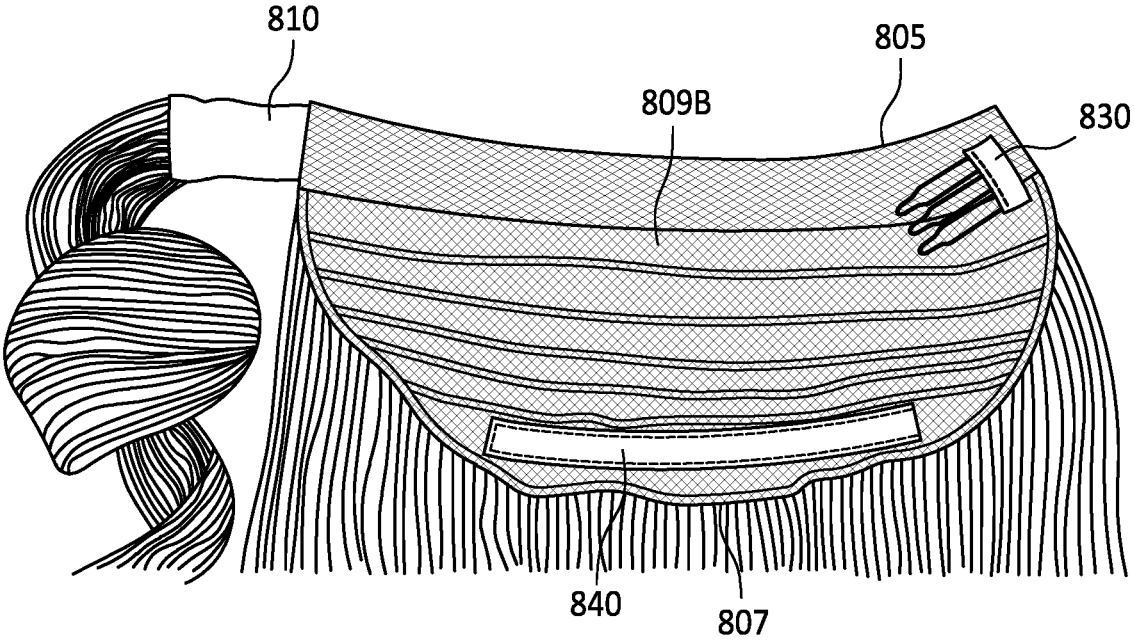
FIG. 27 illustrates the hair extension apparatus including a first wire member.

FIG. 27 illustrates the hair extension apparatus 800 including a first wire member 840 coupled to the bottom surface 809B of the first base member 805. The first wire member 840 may be sewn directly to the bottom surface 809B of the first base member 805. Alternatively, the first wire member 840 may be coupled to the bottom surface 809B by sewing a piece of mesh over the first wire member 840 to the bottom surface 809B such that the first wire member 840 is held between the piece of mesh and the bottom surface 809B. The first wire member 840 is disposed adjacent to, and parallel to, the first rear edge 806. The first wire member 840 is constructed of a material that is sufficiently flexible to bend when the user wraps the first base member 805 around their hair but is also sufficiently rigid to provide the first base member 805 with structural support when the first base member 805 is in an unwrapped configuration.

Figure 28:
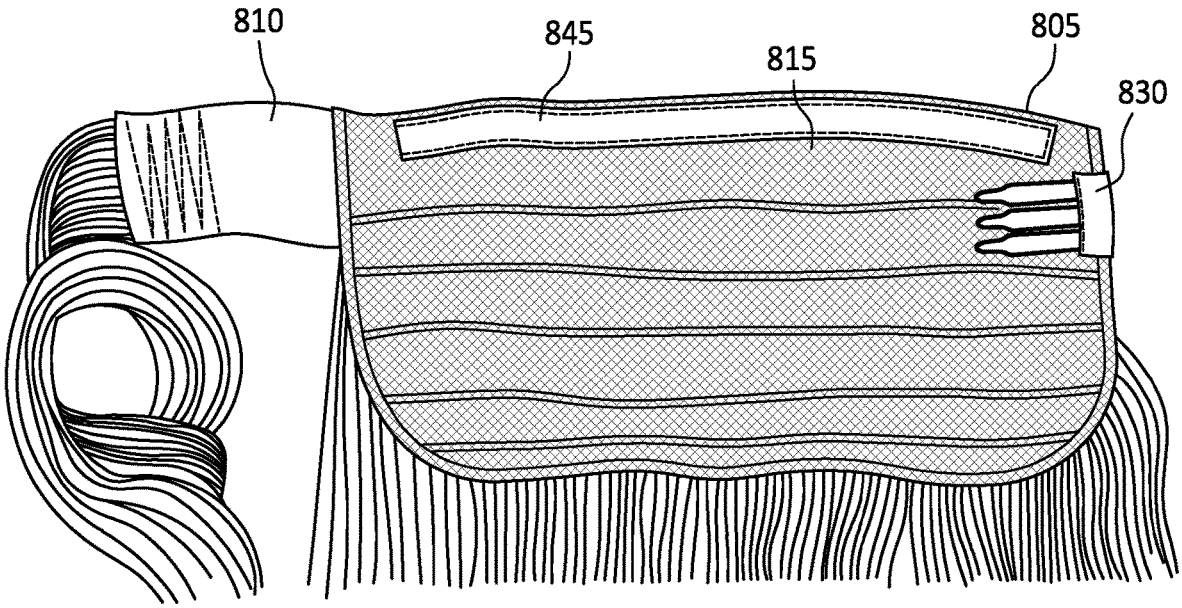
FIG. 28 illustrates the hair extension apparatus including a second wire member.

FIG. 28 illustrates the hair extension apparatus 800 including a second wire member 845 coupled to the bottom surface 809B of the first base member 805. The second wire member 845 may be sewn directly to the bottom surface 809B of the first base member 805. Alternatively, the second wire member 845 may be coupled to the bottom surface 809B by sewing a piece of mesh over the second wire member 845 to the bottom surface 809B such that the second wire member 845 is held between the piece of mesh and the bottom surface 809B. The second wire member 845 is disposed adjacent to, and parallel to, the first front edge 807. At least a portion of the second wire member 845 overlaps at least a portion of the sleeve member 815. The second wire member 845 is constructed of a material that is sufficiently flexible to bend when the user wraps the first base member 805 around their hair but is also sufficiently rigid to provide the first base member 805 with structural support when the first base member 805 is in an unwrapped configuration.

In certain embodiments, the first wire member 840 is disposed parallel to the second wire member 845. In certain embodiments, the first wire member 840 and the second wire member 845 are curved. In certain embodiments, the shape of the first wire member 840 is substantially identical to the shape of the first rear edge 806. In certain embodiments, the shape of the second wire member 845 is substantially identical to the shape of the first front edge 807. In certain embodiments, the shape of the first wire member 840 is substantially straight and the shape of the second wire member 845 is curved.

According to the embodiments of the invention described herein, a hair extension apparatus that is coupled to a user's natural hair is provided. As described herein, the hair extension apparatus includes various components configured to securely couple the hair extension apparatus to the user's natural hair, while also providing a desirable and fashionable appearance.

While embodiments of the invention have been shown and described with reference to certain embodiments thereof, it will be understood by those skilled in the art that various changes in form and details may be made therein without departing from the spirit and scope of the invention and equivalents thereof.

What is claimed is:

1. A hair extension apparatus, comprising:

a first base member comprising a first front edge, a first rear edge, a first top surface and a first bottom surface;

a sleeve member coupled to the first base member along the first front edge, the sleeve member comprising a hole;

a second base member at least partially disposed within the sleeve member, the second base member comprising a first end, a second end, a second top surface and a second bottom surface;

a first artificial hair section comprising artificial hair, wherein the first artificial hair section is coupled to the first top surface of the first base member; and a second artificial hair section comprising artificial hair, wherein the second artificial hair section is coupled to the second top surface of the second base member, wherein the sleeve member extends along the entire first front edge.

2. The hair extension apparatus according to claim 1, wherein the sleeve member is adjacent to the first side edge and the second side edge but does not extend around any portion of the first rear edge.

3. A hair extension apparatus, comprising:

a first base member comprising a first front edge, a first rear edge, a first top surface and a first bottom surface;

a sleeve member coupled to the first base member along the first front edge, the sleeve member comprising a hole;

a second base member at least partially disposed within the sleeve member, the second base member comprising a first end, a second end, a second top surface and a second bottom surface;

a first artificial hair section comprising artificial hair, wherein the first artificial hair section is coupled to the first top surface of the first base member; and a second artificial hair section comprising artificial hair, wherein the second artificial hair section is coupled to the second top surface of the second base member, wherein the first side edge and the second side edge are not coupled together.

4. A hair extension apparatus, comprising:

a first base member comprising a first front edge, a first rear edge, a first top surface and a first bottom surface;

a sleeve member coupled to the first base member along the first front edge, the sleeve member comprising a hole;

a second base member at least partially disposed within the sleeve member, the second base member comprising a first end, a second end, a second top surface and a second bottom surface;

a first artificial hair section comprising artificial hair, wherein the first artificial hair section is coupled to the first top surface of the first base member; and a second artificial hair section comprising artificial hair, wherein the second artificial hair section is coupled to the second top surface of the second base member, wherein the hole is adjacent to the first side edge.

5. A hair extension apparatus, comprising:

a first base member comprising a first front edge, a first rear edge, a first top surface and a first bottom surface;

a sleeve member coupled to the first base member along the first front edge, the sleeve member comprising a hole;

a second base member at least partially disposed within the sleeve member, the second base member comprising a first end, a second end, a second top surface and a second bottom surface;

a first artificial hair section comprising artificial hair, wherein the first artificial hair section is coupled to the first top surface of the first base member; and a second artificial hair section comprising artificial hair, wherein the second artificial hair section is coupled to the second top surface of the second base member, wherein the first end of the second base member is coupled to the interior of the sleeve member.

6. The hair extension apparatus according to claim 5, wherein the second end of the second base member is not within the sleeve member.

7. A hair extension apparatus, comprising:

a first base member comprising a first front edge, a first rear edge, a first top surface and a first bottom surface;

a sleeve member coupled to the first base member along the first front edge, the sleeve member comprising a hole;

a second base member at least partially disposed within the sleeve member, the second base member comprising a first end, a second end, a second top surface and a second bottom surface;

a first artificial hair section comprising artificial hair, wherein the first artificial hair section is coupled to the first top surface of the first base member;

a second artificial hair section comprising artificial hair, wherein the second artificial hair section is coupled to the second top surface of the second base member; and a fastener member coupled to the first bottom surface of the first base member.

8. The hair extension apparatus according to claim 7, wherein the fastener member is coupled to the first front edge overlapping the first end of the second base member.

9. The hair extension apparatus according to claim 8, wherein the fastener member is a comb that includes tines.

10. The hair extension apparatus according to claim 9, wherein the tines of the fastener member are disposed pointing in a direction away from the second side edge towards the first side edge.

11. The hair extension apparatus according to claim 7, further comprising a hair band member coupled to the first bottom surface of the first base member.

12. The hair extension apparatus according to claim 11, wherein the hair band member is coupled to the first bottom surface adjacent to the first rear edge and adjacent to the second side edge.

13. The hair extension apparatus according to claim 11, wherein the hair band member is disposed on the same side of the first base member as the fastener member.

14. The hair extension apparatus according to claim 11, wherein the hair band member is disposed on the same side of the first base member as the second end of the second base member.

15. The hair extension apparatus according to claim 11, wherein the hair band member is configured as a loop and is constructed of an elastic material.

16. A hair extension apparatus, comprising:

a first base member comprising a first front edge, a first rear edge, a first top surface and a first bottom surface;

a sleeve member coupled to the first base member along the first front edge, the sleeve member comprising a hole;

a second base member at least partially disposed within the sleeve member, the second base member comprising a first end, a second end, a second top surface and a second bottom surface;

a first artificial hair section comprising artificial hair, wherein the first artificial hair section is coupled to the first top surface of the first base member;

a second artificial hair section comprising artificial hair, wherein the second artificial hair section is coupled to the second top surface of the second base member; and a first wire member coupled to the bottom surface of the first base member, wherein the first wire member is disposed adjacent to the first rear edge.

17. The hair extension apparatus according to claim 16, wherein a shape of the first wire member is substantially identical to a shape of the first rear edge.

18. The hair extension apparatus according to claim 16, further comprising a second wire member coupled to the bottom surface of the first base member, wherein the second wire member is disposed adjacent to the first front edge.

19. The hair extension apparatus according to claim 18, wherein a shape of the second wire member is substantially identical to a shape of the first front edge.

* * * * *